US011086255B2

(12) United States Patent
Tsujimura et al.

(10) Patent No.: US 11,086,255 B2
(45) Date of Patent: Aug. 10, 2021

(54) IMAGE FORMING APPARATUS

(71) Applicant: CANON KABUSHIKI KAISHA, Tokyo (JP)

(72) Inventors: Takashi Tsujimura, Toride (JP); Hisashi Tsukijima, Toride (JP); Kensuke Kaneko, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/840,567

(22) Filed: Apr. 6, 2020

(65) Prior Publication Data

US 2020/0341409 A1 Oct. 29, 2020

(30) Foreign Application Priority Data

Apr. 26, 2019 (JP) ..... JP2019-086718

(51) Int. Cl.
*G03G 15/00* (2006.01)
*G03G 15/16* (2006.01)

(52) U.S. Cl.
CPC ..... *G03G 15/1615* (2013.01)

(58) Field of Classification Search
CPC ..... G03G 15/00; G03G 15/1615
USPC ..... 399/381, 394–396
See application file for complete search history.

(56) References Cited

U.S. PATENT DOCUMENTS 8,565,655 B2 * 10/2013 Shida ..... G03G 15/161 399/313
10,372,069 B2 8/2019 Yamana et al.
2008/0175612 A1 * 7/2008 Oikawa ..... G03G 15/161 399/66

FOREIGN PATENT DOCUMENTS

JP 2014-202983 A 10/2014
JP 2017-037097 A 2/2017

* cited by examiner

*Primary Examiner* — Hoan H Tran
(74) *Attorney, Agent, or Firm* — Venable LLP

(57) ABSTRACT

An image forming apparatus includes an image bearing member, a transfer member, a conveyance unit arranged upstream of a transfer portion in a sheet conveyance direction, an upstream conveyance unit arranged upstream of the conveyance unit, a drive unit configured to drive the conveyance unit; and a controller to control the drive unit to change a conveyance speed of the conveyance unit. In a case where a trailing edge of the sheet passes through the upstream conveyance unit after a leading edge of the sheet in the sheet conveyance direction has entered the transfer portion, the conveyance unit conveys the sheet by a first speed before the trailing edge of the sheet passes through the upstream conveyance unit, and by a second speed that is faster than the first speed after the trailing edge of the sheet has passed through the upstream conveyance unit.

14 Claims, 28 Drawing Sheets

FIG.22

| No | SHEET LENGTH L [mm] | MAGNITUDE CORRELATION OF CONVEYANCE TIMING |
|---|---|---|
| 1 | 393mm $\leq L$ | $T_{i2} < T_{i1} \leq T_{o5b} < T_{o5a} < T_{o4a} < T_{o3}$ |
| 2 | 351mm $\leq L <$ 393mm | $T_{i2} < T_{o5b} < T_{i1} \leq T_{o5a} < T_{o4a} < T_{o3}$ |
| 3 | 307mm $\leq L <$ 351mm | $T_{i2} \leq T_{o5b} < T_{o5a} < T_{i1} < T_{o4a} < T_{o3}$ |
| 4 | 263mm $\leq L <$ 307mm | $T_{i2} \leq T_{o5a} < T_{i1} < T_{o4a} < T_{o3}$ |
| 5 | 256mm $\leq L <$ 263mm | $T_{i2} < T_{i1} \leq T_{o4a} < T_{o3}$ |
| 6 | 168mm $\leq L <$ 256mm | $T_{i2} \leq T_{o4a} < T_{i1} < T_{o3}$ |
| 7 | 158mm $\leq L <$ 168mm | $T_{i2} < T_{i1} \leq T_{o3}$ |
| 8 | $L <$ 158mm | $T_{i2} < T_{o3}$ |

FIG.28

| No | SHEET LENGTH L [mm] | MAGNITUDE CORRELATION OF CONVEYANCE TIMING |
|---|---|---|
| 1 | 492mm $\leq L$ | $T_{i2} < T_{i1} \leq T_{o6b} < T_{o6a} < T_{o5a} < T_{o4a} < T_{o3}$ |
| 2 | 448mm $\leq L <$ 492mm | $T_{i2} < T_{o6b} < T_{i1} \leq T_{o6a} < T_{o5a} < T_{o4a} < T_{o3}$ |
| 3 | 404mm $\leq L <$ 448mm | $T_{i2} \leq T_{o6b} < T_{o6a} < T_{i1} < T_{o5a} < T_{o4a} < T_{o3}$ |
| 4 | 360mm $\leq L <$ 404mm | $T_{i2} \leq T_{o6a} < T_{i1} < T_{o5a} < T_{o4a} < T_{o3}$ |
| 5 | 351mm $\leq L <$ 360mm | $T_{i2} < T_{i1} \leq T_{o5a} < T_{o4a} < T_{o3}$ |
| 6 | 263mm $\leq L <$ 351mm | $T_{i2} \leq T_{o5a} < T_{i1} < T_{o4a} < T_{o3}$ |
| 7 | 256mm $\leq L <$ 263mm | $T_{i2} < T_{i1} \leq T_{o4a} < T_{o3}$ |
| 8 | 168mm $\leq L <$ 256mm | $T_{i2} \leq T_{o4a} < T_{i1} < T_{o3}$ |
| 9 | 158mm $\leq L <$ 168mm | $T_{i2} < T_{i1} \leq T_{o3}$ |
| 10 | $L <$ 158mm | $T_{i2} < T_{o3}$ |

IMAGE FORMING APPARATUS

BACKGROUND OF THE INVENTION

Field of the Invention

The present invention relates to an image forming apparatus for forming images on sheets.

Description of the Related Art

In image forming apparatuses adopting an electrophotographic system, a toner image borne on an image bearing member such as a photosensitive drum or an intermediate transfer belt is transferred to a sheet serving as a recording medium at a transfer portion, and thereafter, fixed by a fixing unit onto the sheet. A plurality of conveyance members for nipping and conveying sheets, including a registration roller pair that feeds the sheets to the transfer portion, are arranged along a sheet conveyance path that passes the transfer portion and the fixing unit.

Conveyance speed of the sheets by such registration roller pair may be varied in midway of conveyance operation of the sheet. Japanese Patent Application Laid-Open Publication No. 2014-202983 discloses decelerating conveyance speed before a trailing edge of the sheet passes through the registration roller pair to thereby reduce distortion of the sheet between the registration roller pair and the transfer portion, and relieving impact that occurs when the trailing edge of the sheet passes through the registration roller pair. Japanese Patent Application Laid-Open Publication No. 2017-37097 discloses increasing the conveyance speed of the registration roller pair after a leading edge of the sheet enters a fixing nip, so that the effect of distortion of the sheet from the transfer portion to the fixing nip is cancelled out by the distortion of the sheet from the registration roller pair to the transfer portion.

The above-described document points out that distortion of the sheet within a range from the registration roller pair through a secondary transfer portion to a fixing portion affects the transfer of toner image at the secondary transfer portion. However, the inventors of the present invention have discovered through studies that an image transferred onto a sheet is disturbed by causes related to behavior of the sheet due to problems other than distortion of the sheet within this range.

SUMMARY OF THE INVENTION

The present invention provides an image forming apparatus capable of reducing image distortion.

According to one aspect of the invention, an image forming apparatus includes: an image bearing member configured to bear a toner image and rotate; a transfer member configured to form a transfer portion between the transfer member and the image bearing member and transfer the toner image at the transfer portion from the image bearing member to a sheet; a conveyance unit arranged upstream of the transfer portion in a sheet conveyance direction and configured to convey the sheet toward the transfer portion; an upstream conveyance unit arranged upstream of the conveyance unit in the sheet conveyance direction and configured to convey the sheet toward the conveyance unit; a drive unit configured to drive the conveyance unit; and a controller configured to control the drive unit to change a conveyance speed of the conveyance unit so that, in a case where a trailing edge of the sheet in the sheet conveyance direction passes through the upstream conveyance unit after a leading edge of the sheet in the sheet conveyance direction has entered the transfer portion, the conveyance unit conveys the sheet by a first speed before the trailing edge of the sheet passes through the upstream conveyance unit, and by a second speed that is faster than the first speed after the trailing edge of the sheet has passed through the upstream conveyance unit.

Further features of the present invention will become apparent from the following description of exemplary embodiments with reference to the attached drawings.

BRIEF DESCRIPTION OF THE DRAWINGS

FIG. 22 is a view illustrating a relationship between conveyance-direction length and magnitude correlation of conveyance timing, that is, correlation of time order of events, of the sheet fed from the second feeding portion according to the second embodiment.

FIG. 28 is a view illustrating a relationship between conveyance-direction length and magnitude correlation of conveyance timing, that is, correlation of time order of events, of a sheet fed from the third feeding portion according to the second embodiment.

DESCRIPTION OF THE EMBODIMENTS

Now, exemplary embodiments for carrying out the present invention will be described with reference to the drawings.

First Embodiment

Figure 1:
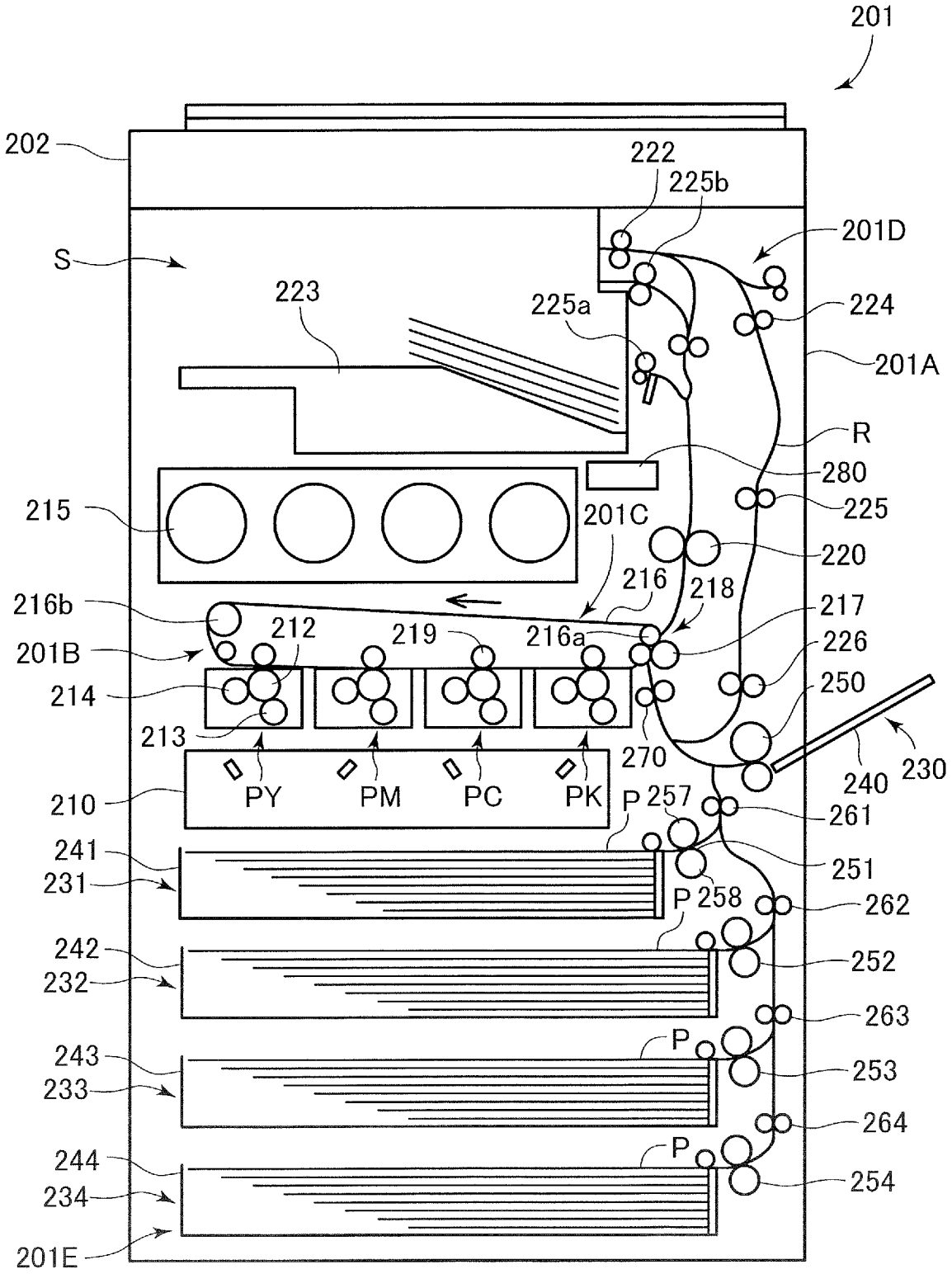
FIG. 1 is a schematic drawing of an image forming apparatus according to a first embodiment.

FIG. 1 is a schematic drawing of an image forming apparatus 201 according to a first embodiment. The image forming apparatus 201 is a laser printer equipped with an image forming portion 201B that adopts an electrophotographic system. An image reading apparatus 202 is installed approximately horizontally on an upper portion of an image forming apparatus body (hereinafter referred to as apparatus body) 201A. A sheet discharge space S to which sheets are discharged is formed between the image reading apparatus 202 and the apparatus body 201A.

The image forming portion 201B serving as an example of an image forming portion is a four-drum full-color electrophotographic unit. That is, the image forming portion 201B is equipped with a laser scanner 210 and four process cartridges PY, PM, PC and PK that form toner images of four colors, which are yellow (Y), magenta (M), cyan (C) and black (K). The process cartridges PY to PK are image forming units each equipped with a photosensitive drum 212 serving as a photosensitive member, a charger 213 serving as a charging unit, and a developer 214 serving as a developing portion. Further, the image forming portion 201B is equipped with an intermediate transfer unit 201C arranged above the process cartridges PY to PK, and a fixing portion 220. Toner cartridges 215 configured to supply toner to the respective developers 214 are attached to a portion above the intermediate transfer unit 201C.

The intermediate transfer unit 201C is equipped with an intermediate transfer belt 216 wound around a driving roller 216*a* and a tension roller 216*b*. A primary transfer roller 219 that contacts the intermediate transfer belt 216 at a position opposed to each photosensitive drum 212 is provided on an inner side of the intermediate transfer belt 216. The intermediate transfer belt 216 is rotated in a counterclockwise direction in the drawing by the driving roller 216*a* driven by a driving unit not shown.

A secondary transfer roller 217 that transfers a color image borne on the intermediate transfer belt 216 to a sheet P is provided at a position opposed to the driving roller 216*a* of the intermediate transfer unit 201C. The fixing portion 220 is arranged above the secondary transfer roller 217, and a first sheet discharge roller pair 225*a*, a second sheet discharge roller pair 225*b* and a duplex reverse portion 201D are arranged above the fixing portion 220. The duplex reverse portion 201D includes a reverse conveyance roller pair 222 capable of rotating in normal and reverse directions, and a reconveyance path R that conveys the sheet on which an image has been formed on one side to the image forming portion 201B again. Further, a control unit 280 serving as a controller for controlling an image forming operation by which the image forming portion 201B creates a toner image and a sheet feeding operation for feeding sheets is installed in the image forming apparatus 201.

An image forming operation of the image forming portion 201B will be described. Image information of a document is read by the image reading apparatus 202 and subjected to image processing by the control unit 280, before being converted into electric signals and transferred to the laser scanner 210 of the image forming portion 201B. In the image forming portion 201B, laser beam is irradiated from the laser scanner 210 to the photosensitive drum 212 whose surface has been charged uniformly to predetermined polarity and potential by the charger 213, and the drum surface is exposed along with the rotation of the drum. Thereby, an electrostatic latent image corresponding to a single-color image of yellow, magenta, cyan and black is formed to the surface of the photosensitive drum 212 of each of the respective process cartridges PY to PK. The electrostatic latent images are developed and visualized by toner of respective colors supplied from the developers 214, and the images are primarily transferred in a mutually overlapped manner from the photosensitive drums 212 to the intermediate transfer belt 216 by primary transfer bias applied to the primary transfer roller 219.

The image forming apparatus 201 includes a sheet feeding unit 201E for feeding the sheet P. The sheet feeding unit 201E according to the present embodiment includes a first feeding portion 231, a second feeding portion 232, a third feeding portion 233 and a fourth feeding portion 234 for feeding sheets P stored in each cassette 241, 242, 243 and 244. The first feeding portion 231 includes a first cassette 241, a first feed roller pair 251 and a first drawing roller pair 261. The second feeding portion 232 includes a second cassette 242, a second feed roller pair 252 and a second drawing roller pair 262. The third feeding portion 233 includes a third cassette 243, a third feed roller pair 253 and a third drawing roller pair 263. The fourth feeding portion 234 includes a fourth cassette 244, a fourth feed roller pair 254 and a fourth drawing roller pair 264.

The respective cassettes 241 to 244 are examples of a supporting portion that supports the sheets P serving as recording material, and they can be inserted to and drawn out of the apparatus body 201A. Examples of the sheet P serving as the recording material include paper such as plain paper and thick paper, plastic films such as OHP sheets, cloth, sheet material subjected to surface treatment such as coated paper, and sheet material having a special shape such as an envelope or an index paper.

The respective feed roller pairs 251 to 254 include feed rollers 257 that feed sheets P from corresponding cassettes 241 to 244, and retard rollers 258 that contact respective feed rollers 257. The retard roller 258 receives a drive force in a direction opposing to rotation of the feed roller 257 through a torque limiter, for example. The retard roller 258 separates the sheet P conveyed by the feed roller 257 from other sheets P by applying frictional force to the sheet(s) P that has entered a separation nip between the feed roller 257. As described, the respective feed roller pairs 251 to 254 are configured to feed the sheets P from the cassettes 241 to 244 one at a time. The feed units described above are examples of a feed unit for feeding sheets, and for example, other members such as a pad-shaped friction member or a roller member connected to a shaft fixed to the apparatus body through a torque limiter can be used as a separation member for separating sheets.

The sheets P fed from the cassettes 241 to 244 by the feed roller pairs 251 to 254 are conveyed through drawing roller pairs 261 to 264 which are conveyance roller pairs for conveying sheets toward a registration roller pair 270. In this operation, the sheets P conveyed from cassettes 242 to 244 other than the uppermost cassette is conveyed upward toward the registration roller pair 270 by being transferred through the drawing roller pairs 261 to 263 corresponding to the cassettes arranged upward therefrom. For example, the sheet P fed from the third feeding portion 233 is supplied from the third cassette 243 by the third feed roller pair 253, passes the third drawing roller pair 263, the second drawing roller pair 262 and the first drawing roller pair 261 in the named order and conveyed to the registration roller pair 270.

Further, the sheet feeding unit 201E of the present embodiment includes a manual sheet feed portion 230, i.e., multi-purpose feed portion, to which the user can set sheets as needed. The sheets set to the manual feed tray 240 are conveyed one by one by a feed roller pair 250 composed of a feed roller and a separation roller toward the registration roller pair 270.

After correcting skewing of the sheet P, the registration roller pair 270 sends the sheet P toward a secondary transfer portion 218 formed between the secondary transfer roller 217 and the intermediate transfer belt 216 based on a timing to start formation of toner image by the image forming portion 201B. At the secondary transfer portion 218, a full-color toner image is collectively secondarily transferred to the sheet P by applying secondary transfer bias to the secondary transfer roller 217 serving as a transfer member of the present embodiment. The sheet P to which toner image has been transferred is conveyed to the fixing portion 220, and toner of various colors is melted and mixed by heat and pressure applied at the fixing portion 220, and the toner image is fixed as a color image to the sheet P.

Thereafter, the sheet P is placed on a sheet discharge portion 223 arranged on a bottom portion of the sheet discharge space S through the first sheet discharge roller pair 225*a* or the second sheet discharge roller pair 225*b* arranged downstream of the fixing portion 220. In a state where image is to be formed on both sides of the sheet P, the sheet P on which an image is formed on a first side is conveyed to the reconveyance path R in a state being reversed by the reverse conveyance roller pair 222 serving as a reverse conveyance unit. Further, in a state where the sheet P reaches the registration roller pair 270 again by reconveyance roller pairs 224, 225 and 226 arranged on the reconveyance path R, the sheet P is conveyed by the registration roller pair 270 to the image forming portion 201B. Then, the sheet P on which image is formed on a second side opposite from the first side in the image forming portion 201B is discharged by the first sheet discharge roller pair 225*a* or the second sheet discharge roller pair 225*b* to the sheet discharge portion 223.

The image forming portion 201B described above is one example of an image forming portion, and a direct-transfer image forming portion in which a toner image formed on the photosensitive member is directly transferred to the sheet can also be used. It is also possible to use an ink-jet or offset-printing type image forming portion instead of the electrophotographic system.

Conveyance Path

Figure 2:
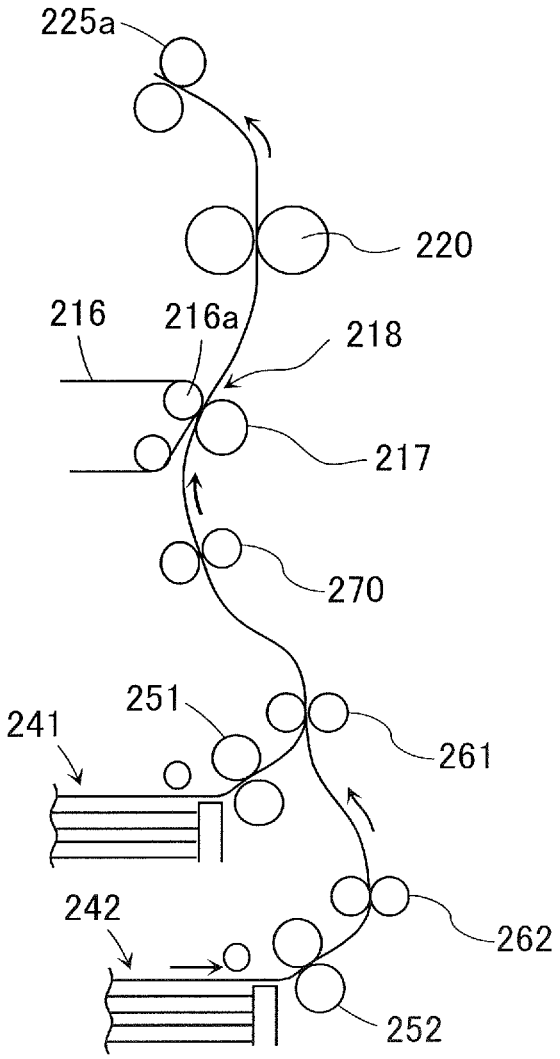
FIG. 2 is a view illustrating an example of a conveyance path of a sheet according to the first embodiment.

Next, the conveyance path of the sheet P will be described in detail. FIG. 2 is a schematic drawing illustrating the conveyance path of the sheet P of a case where the sheet P is fed from the second feeding portion 232 to have image formed thereto, and thereafter, the sheet is discharged from the first sheet discharge roller pair 225*a*. In this case, the conveyance path of the sheet P is composed of the second feed roller pair 252, the second drawing roller pair 262, the first drawing roller pair 261, the registration roller pair 270, the secondary transfer portion 218, the fixing portion 220 and the first sheet discharge roller pair 225*a*. That is, the sheet P fed from the second cassette 242 is passed through the plurality of conveyance members in the named order as shown by the arrow of FIG. 2 and is generally conveyed upward from a lower area in the apparatus body. Now, the direction in which the sheet is conveyed within the apparatus body along the conveyance path is referred to as a "conveyance direction" of the sheet.

The second feed roller pair 252 is a conveyance roller pair configured by the feed roller and the retard roller as described above, and it nips and conveys the sheet by a nip portion of the roller pair. The feed roller and the retard roller are connected to a feed motor M1 (FIG. 17) and driven to rotate, thereby separating the sheets P fed from the second cassette 242 by a pickup roller one by one and conveying the sheet downward in a conveyance direction toward the second drawing roller pair 262.

The second drawing roller pair 262 and the first drawing roller pair 261 are conveyance roller pairs that are respectively composed of a pair of conveyance rollers. The respective drawing roller pairs 261 and 262 are connected to and driven to rotate by a conveyance motor M2 (FIG. 17), thereby nipping the sheet P conveyed from a direction upstream in the conveyance direction by a nip portion between the roller pair and conveying the sheet P downstream in the conveyance direction toward the registration roller pair 270.

The registration roller pair 270 is a conveyance roller pair that is composed of a first registration roller and a second registration roller serving as a pair of conveyance rollers. The registration roller pair 270 is a conveyance unit according to the present embodiment that conveys sheets to the secondary transfer portion 218 serving as a transfer portion according to the present embodiment. The registration roller pair 270 is connected to and driven to rotate by a registration motor M3 (FIG. 17), thereby nipping the sheet P having been conveyed from the upstream side in the conveyance direction by a nip portion of the registration roller pair 270 and conveying the sheet P downstream in the conveyance direction toward the secondary transfer portion 218.

The secondary transfer portion 218 is formed as a nip portion between the secondary transfer roller 217 and the intermediate transfer belt 216 whose inner circumference surface is supported by the driving roller 216*a*. The driving roller 216*a* and the secondary transfer roller 217 are respectively connected to and driven to rotate by an image forming motor M4 (FIG. 17), thereby transferring the image to the sheet P nipped at the secondary transfer portion 218 and conveying the sheet P downstream in the conveyance direction toward the fixing portion 220.

The fixing portion 220 includes a fixing nip portion formed as a nip portion between a fixing roller and a pressure roller. The fixing roller and the pressure roller are respectively connected to and driven to rotate by a fixing motor M5 (FIG. 17), thereby fixing the toner image on the sheet P nipped by the fixing nip portion and conveying the sheet P downstream in the conveyance direction toward the first sheet discharge roller pair 225*a*.

In such a conveyance path, conveyance guides for guiding the sheet P are arranged between nip portions of conveyance members arranged adjacent to one another in the conveyance direction. The conveyance guides guide a leading edge, that is, downstream edge in the sheet conveyance direction, of the sheet P sent out from the nip portion of the upstream conveyance member toward the nip portion of the downstream conveyance member. As illustrated, the conveyance path of the sheet is curved at multiple areas, and the sheet P is conveyed in a curved shape along the conveyance path formed by the conveyance guide. Further, some spatial allowance is provided between the conveyance guides that are opposed to one another interposing the conveyance path, and the sheet P can warp in the thickness direction. The level of distortion of the sheet P can be adjusted by the difference between conveyance speeds, that is, peripheral speeds, of conveyance members arranged adjacent one another in the conveyance direction.

Color Misalignment Caused by Sheet

Figure 3A:
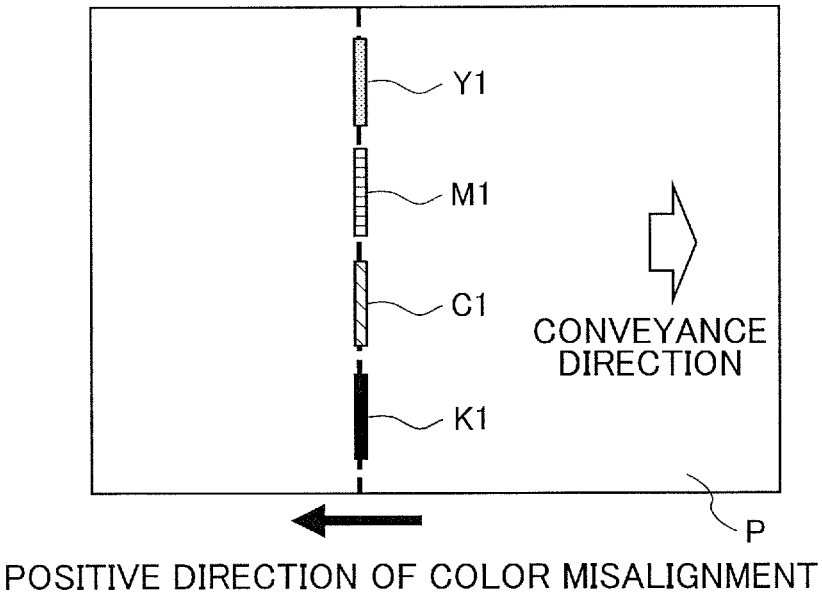
FIG. 3A is an explanatory view of color misalignment.
Figure 3B:
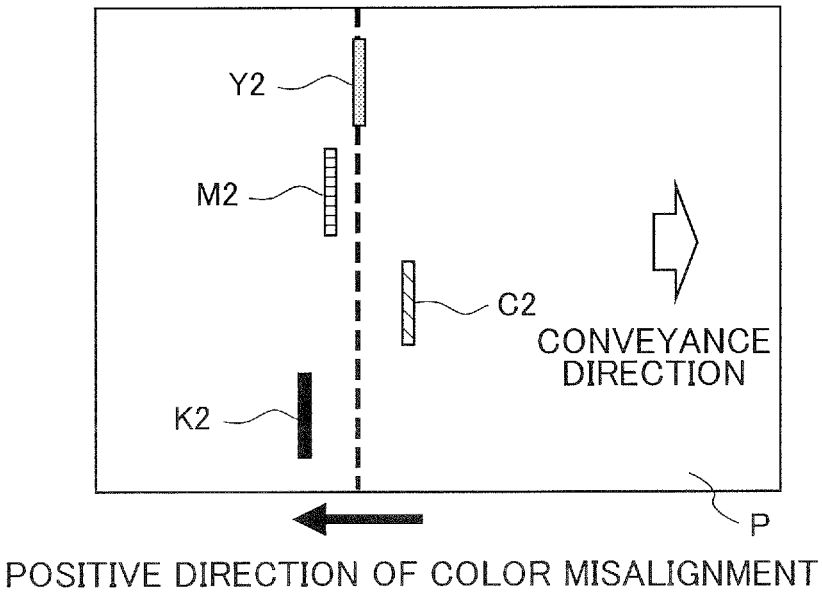
FIG. 3B is an explanatory view of color misalignment.

FIGS. 3A and 3B are schematic diagrams illustrating color misalignment in a conveyance direction, that is, sub-scanning direction of the sheet P, of image formed on the sheet P. In the drawing, Y1, M1, C1 and K1 are images of respective colors, which are yellow, magenta, cyan and black, formed by the image forming portion 201B based on image information that designates an equivalent position on the sheet P with respect to the conveyance direction, and so are Y2, M2, C2 and K2. FIG. 3A illustrates a case where color misalignment in the conveyance direction is not generated, and FIG. 3B illustrates a case where the color misalignment in the conveyance direction is generated.

If under an ideal condition, the respective positions, in the conveyance direction and on the sheet, of the images of respective colors formed based on image information that designates a pixel at a same position in the sub-scanning direction will be aligned as illustrated in FIG. 3A. However, due to fluctuation of conveyance speed of the intermediate transfer belt 216 and the like, the images of respective colors transferred to the sheet P may be displaced in the conveyance direction, as illustrated in FIG. 3B. Now, regarding a transfer position at which the image of a certain color set as reference, such as yellow, is transferred to a sheet, the displacement of transfer positions at which the images of other colors are transferred to the sheet is referred to as color misalignment. Further, displacement from a reference color image toward a downstream side in the conveyance direction is referred to as a color misalignment in a negative direction, and displacement toward an upstream side in the conveyance direction is referred to as a color misalignment in a positive direction.

Figure 4:
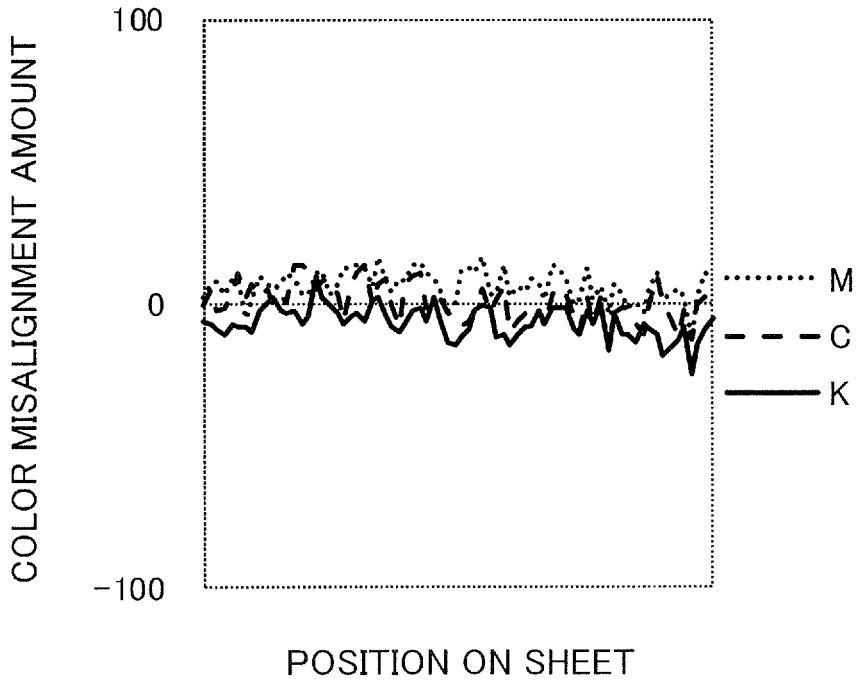
FIG. 4 is a graph illustrating color misalignment caused by sheet in a case where plain paper is used.
Figure 5:
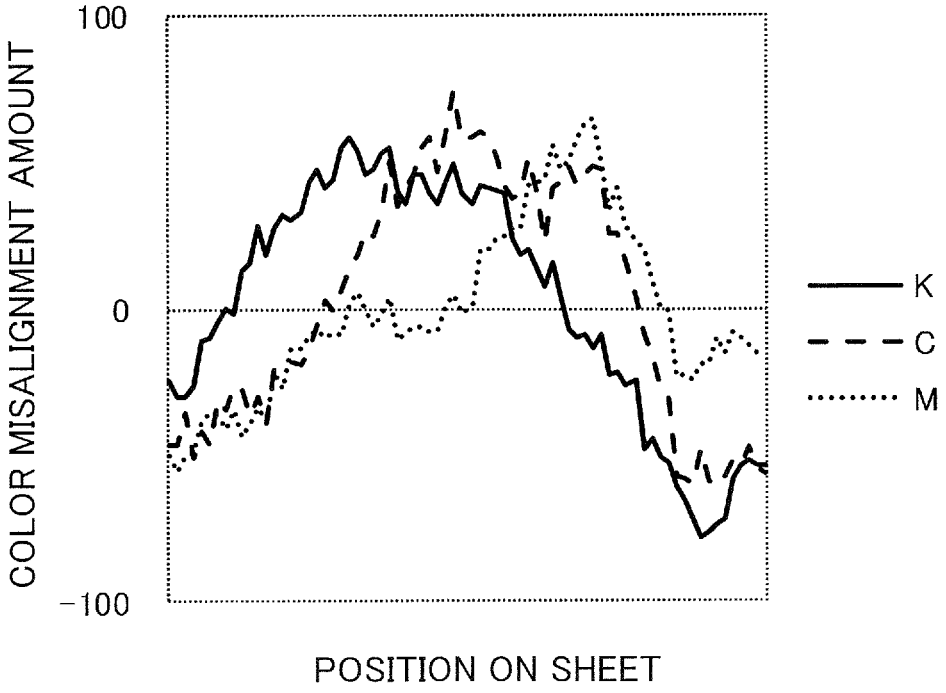
FIG. 5 is a graph illustrating color misalignment caused by sheet in a case of thick paper being used.

FIGS. 4 and 5 are graphs, i.e., color misalignment waveforms, illustrating fluctuation of color misalignment that occurs when forming an image on a sheet, wherein FIG. 4 illustrates a case where image is formed on plain paper, and FIG. 5 illustrates a case where image is formed on a kind of thick paper having a greater grammage than plain paper, which is referred to as "Thick Paper 1" in the following description. In order to acquire the color misalignment waveform, at first, image forming operation is executed by the image forming portion 201B to form images of respective colors at a plurality of positions at certain intervals in the conveyance direction of the sheet. Thereafter, a color misalignment waveform is obtained by observing the output images sequentially in order from a row on a downstream side in the conveyance direction, and plotting an original target position of each row as horizontal axis position and displacement of image of each color corresponding to the image of the color set as reference of each row as vertical axis position. FIGS. 4 and 5 respectively show the color misalignment waveform of a state where an A3-size sheet P that has a length of 420 mm in the conveyance direction is fed from the second feeding portion 232 and discharged from the first sheet discharge roller pair 225*a*. Further, FIGS. 4 and 5 respectively show the color misalignment of magenta (M), cyan (C) and black (K) images with respect to yellow images set as reference. In order to eliminate effects other than sheet type as much as possible, various causes that may affect color misalignment, such as periodic component of rotation cycle of drum, are eliminated by calculation.

By comparing the waveforms of FIGS. 4 and 5, it can be seen that color misalignment is greater in thick paper than in plain paper, which suggests that they are influenced by sheet type.

Next, a principle of how color misalignment caused by sheet occurs will be described. At first, in a state where a sheet is nipped by the intermediate transfer belt 216 and the secondary transfer roller 217 at the secondary transfer portion 218 and conveyed, force directed along the conveyance direction acts on the secondary transfer portion 218 from the sheet. That is, in this state, in the secondary transfer portion 218, force directed along the sheet conveyance direction is mutually applied between the sheet and the intermediate transfer belt 216 or the secondary transfer roller 217. In this state, the direction, such as in a downstream direction or upstream direction in the conveyance direction, or size of force that acts on the secondary transfer portion 218 from the sheet is not fixed, and it fluctuates with time.

Normally, the driving roller 216*a* for driving the intermediate transfer belt 216 is driven at a fixed rotational speed by an image forming motor M4 serving as a driving source. However, if driving load of the image forming motor M4 varies by force applied from the sheet to the secondary transfer portion 218, rotational speed of the motor is changed temporarily, and rotational speed of the driving roller 216*a* may be fluctuated. Further, even if the driving roller 216*a* continues to rotate at a constant speed, the power applied from the sheet to the intermediate transfer belt 216 causes the intermediate transfer belt 216 to slip slightly against the driving roller 216*a*, and the rotational speed of the intermediate transfer belt 216 may be fluctuated. As described, since the direction and size of force acting on the secondary transfer portion 218 from the sheet varies, the conveyance speed of the intermediate transfer belt 216 fluctuates.

If the conveyance speed of the intermediate transfer belt 216 fluctuates, speed difference occurs between the photosensitive drum 212 and the intermediate transfer belt 216 at a primary transfer portion where the intermediate transfer belt 216 is nipped between the photosensitive drum 212 and the primary transfer roller 219. Thereby, displacement of position, i.e., transfer position, where the actual toner image has been primarily transferred occurs compared to a position, i.e., target position, where toner image should have been primarily transferred if the intermediate transfer belt 216 is driven to rotate accurately at a constant speed. Further, since the intermediate transfer belt 216 is pressed against the photosensitive drum 212 by the primary transfer roller 219, the rotation speed of the photosensitive drum 212 may be varied along with the fluctuation of speed of the intermediate transfer belt 216. Similarly, according to that case, the position of the latent image formed by the laser scanner 210 is also displaced with respect to the sub-scanning direction corresponding to the conveyance direction of the sheet, so that as a result, displacement of transfer position occurs.

Such displacement of transfer position of toner image occurs for each of the toner images of respective colors, and positions of primary transfer portions of the respective process cartridges PY to PK are separated from each other by approximately constant intervals in the direction of rotation of the intermediate transfer belt 216. Therefore, if the conveyance speed is fluctuated evenly in the whole circumference of the intermediate transfer belt 216 at a certain moment, due to the fluctuated speed, there is a difference in the timing at which the toner image of the portion where displacement of transfer position has occurred reaches the secondary transfer portion 218.

Figure 6:
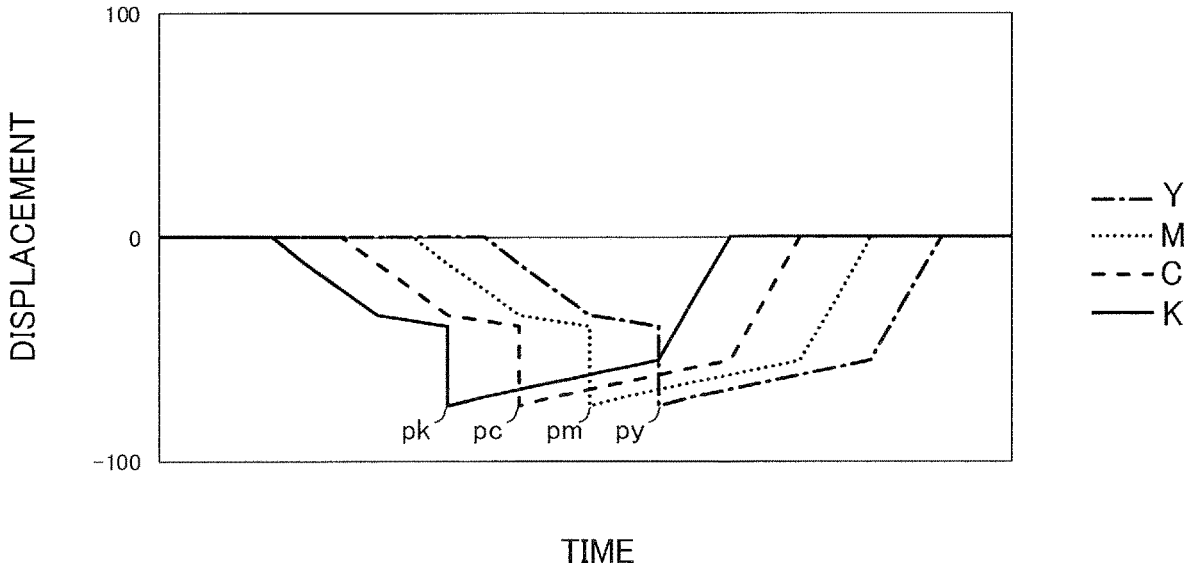
FIG. 6 is a view illustrating misalignment of transfer position of a toner image that has been primarily transferred.

FIG. 6 is a view in which displacement of toner image with respect to target position is plotted on the vertical axis with respect to time at which the toner images of respective colors are transferred to the sheet at the secondary transfer portion 218 on the horizontal axis. In the present embodiment, among the toner images of respective colors in which the transfer position has been displaced from the target position by fluctuation of speed of the intermediate transfer belt 216, a black toner image having the shortest distance from the primary transfer portion to the secondary transfer portion 218 is transferred to the sheet first. Thereafter, toner images of cyan, magenta and yellow, whose primary transfer positions are positioned upstream in the direction of rotation of the intermediate transfer belt 216, having the transfer position displaced from the target position by the fluctuation of speed mentioned above are transferred to the sheet in the named order. As a result, the toner images of respective colors on the sheet are all displaced from the target position, but peek positions py, pm, pc and pk of the amount of displacement with respect to the target position are shifted among the different colors in the conveyance direction.

Figure 7:
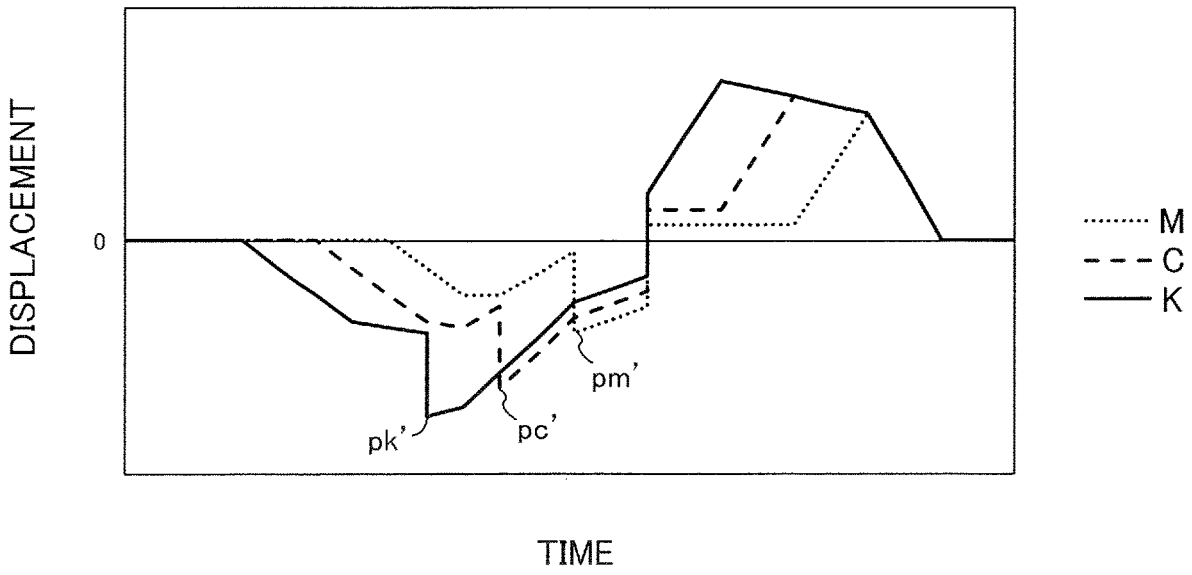
FIG. 7 illustrates an example of color misalignment of toner image that has been secondarily transferred to the sheet, in which yellow is set as reference.

FIG. 7 illustrates a color misalignment waveform of a case where the amount of displacement from the target position illustrated in FIG. 6 is converted into a color misalignment with the yellow image set as reference. Peak positions pm', pc' and pk' of the color misalignment waveform correspond to peak positions pm, pc and pk of the amount of displacement of magenta, cyan and black illustrated in FIG. 6. As illustrated in FIG. 7, it can be recognized that the color misalignment waveforms become apparent from the order of color starting from the color whose primary transfer position is arranged most downstream in the direction of conveyance of the intermediate transfer belt 216, which according to the present embodiment is in the order of black, cyan and magenta.

By confirming the color misalignment waveform of FIG. 5 in a case where image is formed on the sheet of Thick Paper 1, it can be recognized that the peak of color misalignment appears in the named order of black, cyan and magenta. Therefore, it can be estimated that color misalignment is caused to occur in a case where a sheet of Thick Paper 1 having higher stiffness than plain paper is used by "fluctuation of conveyance speed of the intermediate transfer belt 216 by force that acts on the secondary transfer portion 218 from the sheet".

The magnitude of force acting on the secondary transfer portion 218 from the sheet that causes such color misalignment can be observed by measuring driving torque fluctuation of the image forming motor M4 (FIG. 17) that drives the driving roller 216*a*. The present embodiment uses a direct current (DC) brushless motor as the image forming motor M4, and motor output is controlled by pulse width modulation (PWM). In this case, driving torque fluctuation of the image forming motor M4 corresponds to the variation of duty cycle in PWM control. In order to observe fluctuation of driving torque caused by the sheet, the measurement value of driving torque in a case where the image forming apparatus executes an identical operation as the image forming operation but without sheet conveyance, i.e., simulated paper pass through operation, should be subtracted from a measurement value of a case where sheet conveyance is performed.

Figure 8:
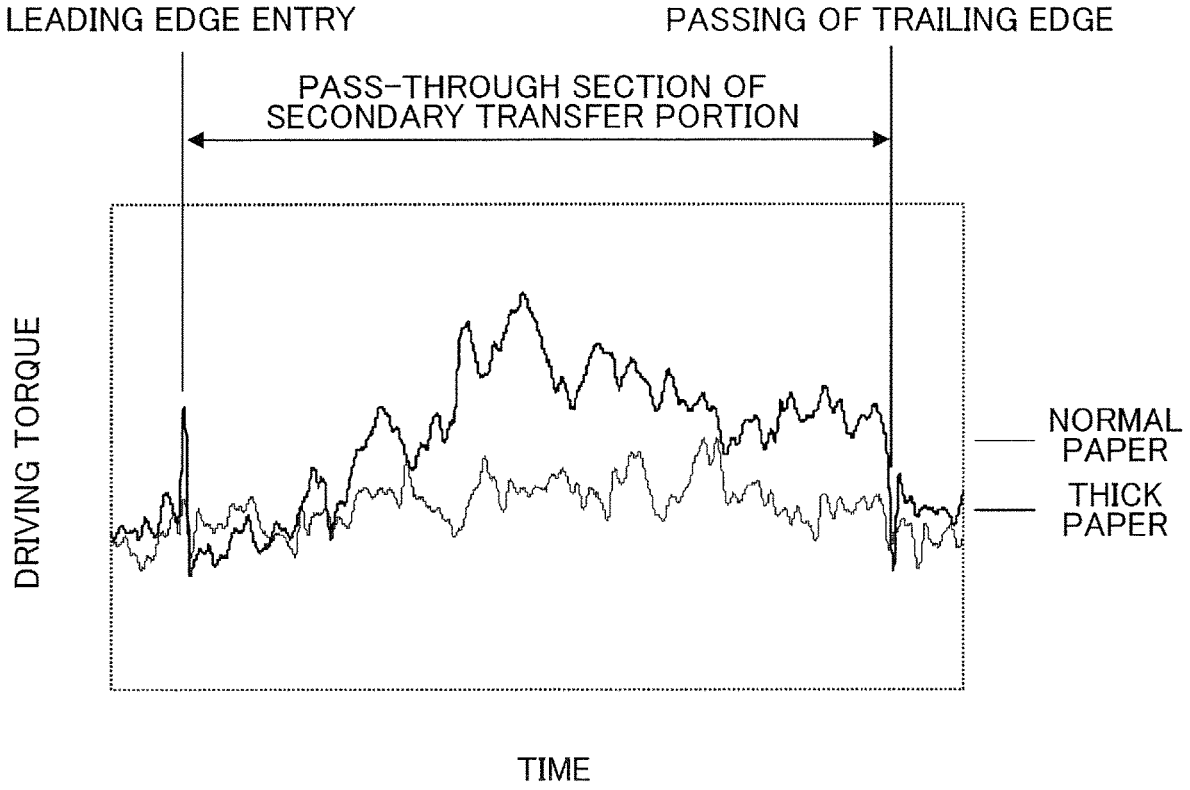
FIG. 8 is a graph illustrating driving torque fluctuation of an image forming motor while the sheet is passing a secondary transfer portion.

FIG. 8 illustrates a driving torque fluctuation of a case where sheet conveyance operation is executed for cases where plain paper is conveyed and where a sheet of Thick Paper 1 is conveyed under the same conditions as FIGS. 4 and 5. Here, a section is illustrated from entry of leading edge of the sheet to the secondary transfer portion 218 to passing of trailing edge of the sheet from the secondary transfer portion 218, that is, pass-through section of secondary transfer portion, where the sheet is considered to affect color misalignment. As illustrated in FIG. 8, driving torque fluctuation of a case where a sheet of Thick Paper 1 having a greater grammage, that is, higher stiffness, is conveyed is greater than a case where plain paper having a smaller grammage, that is, lower stiffness, is conveyed. Therefore, in a case where a sheet of Thick Paper 1 is conveyed, the conveyance speed of the intermediate transfer belt 216 tends to fluctuate by force acting on the intermediate transfer belt 216 from the sheet compared to when plain paper is conveyed, and therefore, it is recognized that color misalignment tends to occur.

Figure 9:
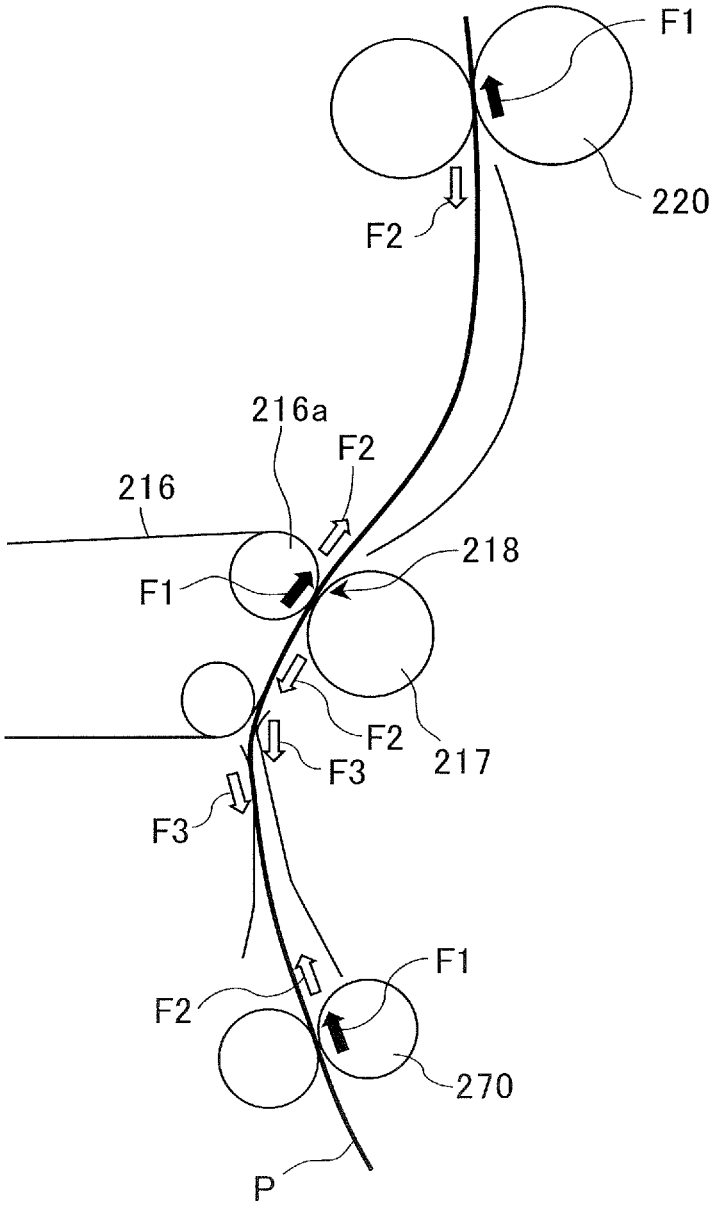
FIG. 9 is a schematic diagram illustrating force acting on a secondary transfer portion from the sheet.

Next, force acting on the secondary transfer portion 218 from the sheet P will be described with reference to FIG. 9. FIG. 9 is a schematic drawing of conveyance path from the registration roller pair 270 to the fixing portion 220.

The following are examples of external force and internal stress that act on the sheet P during conveyance:

- Force F1, i.e., conveyance force, received from rotary drive of conveyance members that nip the sheet P and apply force in the conveyance direction, where the conveyance members refer to the registration roller pair 270, the secondary transfer portion 218 and the fixing portion 220 in the area illustrated in FIG. 9;
- Reaction force F2 caused by stiffness, i.e., elasticity, of the sheet P caused by warping, i.e., elastic deformation, of the sheet P at the nip portions of conveyance members that are arranged adjacent each other in the conveyance direction; and Resultant force F3 of normal force and frictional force that occurs when the sheet P contacts or slides against the conveyance guide forming the conveyance path.

In a state where the sheet P that receives such action of force contacts the intermediate transfer belt 216 or the secondary transfer roller 217 at the secondary transfer portion 218, force from the sheet P is caused to act on the secondary transfer portion 218. In other words, respective members such as the conveyance member and the conveyance guide arranged on the conveyance path of the sheet P are considered to affect the secondary transfer portion 218 via the sheet P. Accordingly, the magnitude of force that acts on the secondary transfer portion 218 from the sheet P is affected by the shape of the conveyance path determined by the arrangement of the conveyance member and the conveyance guide that constitutes the conveyance path, magnitude of distortion of the sheet, stiffness of the sheet, conveyance speed of the sheet (i.e., sheet conveyance speed) of respective conveyance members and so on. Even while conveying a single sheet, these forces F1 to F3 change from moment to moment, so that the force that is applied to the intermediate transfer belt 216 from the sheet P also fluctuates along with the elapse of time.

It is noted that the configuration that influences the force acting on the intermediate transfer belt 216 from the sheet P is not limited to the registration roller pair 270 and the secondary transfer portion 218 or the conveyance guide arranged in the circumference thereof. The sheet P is mostly conveyed in a state nipped simultaneously by a plurality of conveyance members. Therefore, among the forces F1 to F3 mentioned earlier acting on the sheet P, force F1 received from the rotary drive of the conveyance member that nips the sheet P includes the force that the sheet P receives from the conveyance member arranged upstream or downstream in the conveyance direction of the registration roller pair 270 and the secondary transfer portion 218. Examples of the conveyance unit, that is, upstream conveyance unit, that nips and conveys the sheet at a position upstream of the registration roller pair 270 are the first drawing roller pair 261 and the second feed roller pair 252. Further, examples of the conveyance unit, that is, downstream conveyance unit, that nips and conveys the sheet at a position downstream of the secondary transfer portion 218 are the fixing roller pair of the fixing portion 220 and the first sheet discharge roller pair 225*a*.

Therefore, in order to investigate fluctuation of force that acts on the secondary transfer portion 218 from the sheet, it is considered preferable to take elements that are positioned outside the section from the registration roller pair 270 to the secondary transfer portion 218 into consideration.

Figure 10:
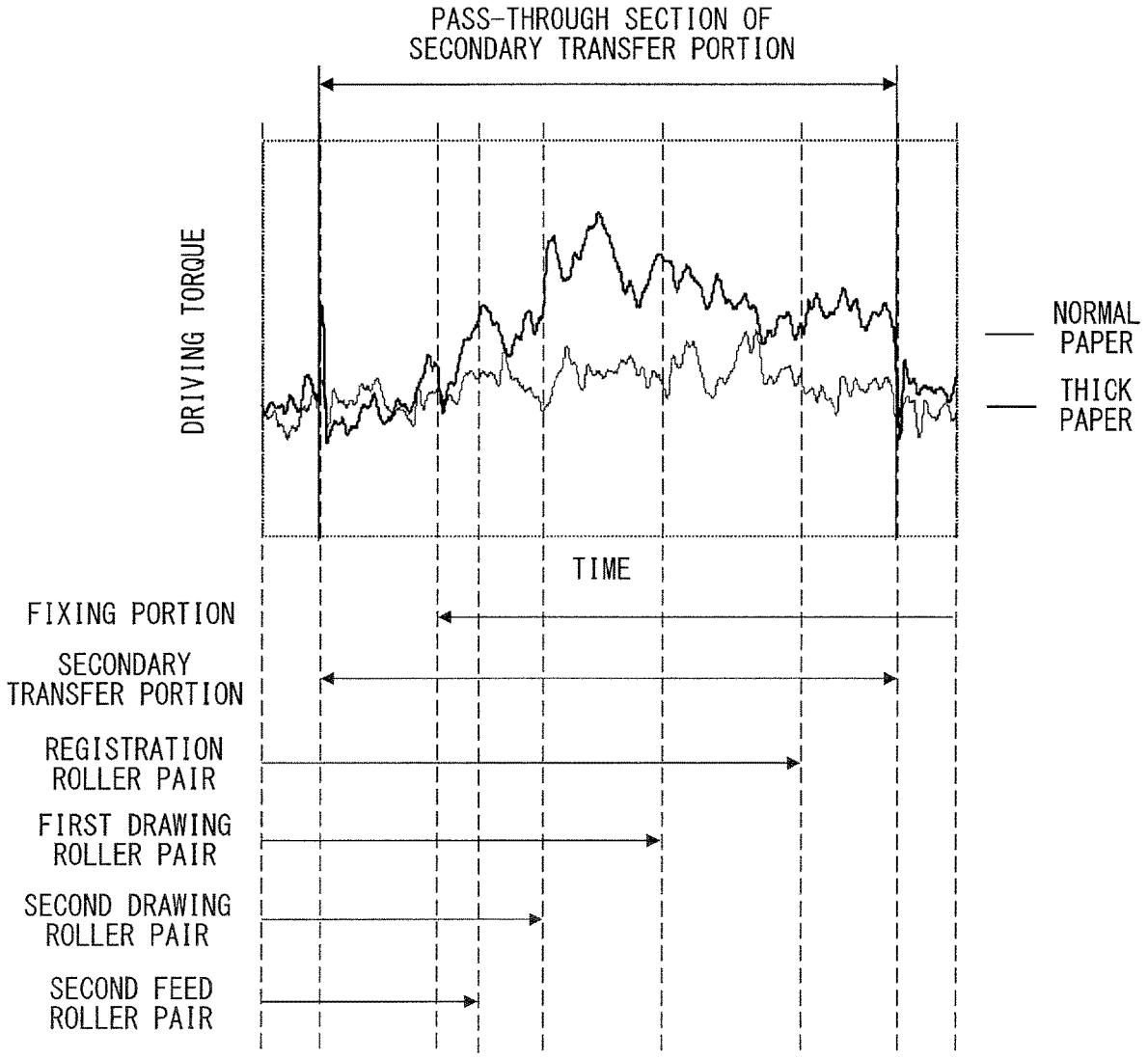
FIG. 10 is a view illustrating a correspondence between driving torque fluctuation and position of a sheet on a conveyance path.

Now, FIG. 10 is a graph in which a section where the respective conveyance members nip the sheet are added to the graph of driving torque fluctuation illustrated in FIG. 8. According to this condition, the leading edge of the sheet enters the secondary transfer portion 218, and thereafter, enters the fixing portion 220. Then, the sheet is conveyed while having the trailing edge of the sheet pass through the second feed roller pair 252, the second drawing roller pair 262, the first drawing roller pair 261, the registration roller pair 270 and the secondary transfer portion 218 in the named order.

In FIG. 10, when focusing on the relationship between the waveform of driving torque fluctuation for thick paper and the sections where the respective conveyance members nip the sheet, it can be recognized that the tendency of fluctuation of driving torque changes before and after the leading edge of the sheet enters the respective conveyance members or before and after the trailing edge of the sheet passes therethrough. Specifically, after the leading edge of the sheet enters the secondary transfer portion 218, the driving torque starts to increase gradually, and when the leading edge of the sheet enters the fixing portion 220, the inclination thereof increases. Further, at a timing when the trailing edge of the sheet passes through the second drawing roller pair 262, the driving torque increases in steps. These driving torque fluctuations indicate that the force acting on the secondary transfer portion 218 from the sheet, or the tendency of change of the force, is changed at a timing when the leading edge of the sheet enters the respective conveyance members or the trailing edge of the sheet passes therethrough.

The main phenomenon that has occurred in the example of FIG. 10 will be described. At first, in a state where the leading edge of the sheet enters the fixing portion 220, distortion (warping) of the sheet between the secondary transfer portion 218 and the fixing portion 220 begin to increase. This is because the conveyance speed of the sheet at the fixing portion 220 is set somewhat slower than the secondary transfer portion 218 so as to prevent the sheet from being pulled by the secondary transfer portion 218 and the fixing portion 220 and causing deterioration of the transfer image. Since the distortion of sheet between the secondary transfer portion 218 and the fixing portion 220 is increased by the difference in conveyance speed, the force that the sheet applies on the intermediate transfer belt 216 in the direction pressing the belt toward the upstream side in the conveyance direction is gradually incased in the secondary transfer portion 218 (refer to FIG. 9). This force acts to gradually increase the driving load of the driving roller 216*a*.

In a state where the trailing edge of the sheet passes through the second drawing roller pair 262, conveyance force (F1) received by the sheet from the second drawing roller pair 262 is lost before or after passing. That is, since the force applied from the second drawing roller pair 262 to the sheet to move the sheet downstream in the conveyance direction is lost, the force in which the sheet presses the intermediate transfer belt 216 toward the downstream side in the conveyance direction at the secondary transfer portion 218 is reduced discontinuously. This causes the driving load of the driving roller 216*a* to be increased in a stepwise manner.

As described, the force acting on the secondary transfer portion 218 from the sheet also fluctuates by the positional relationship between the sheet and the upstream conveyance unit positioned upstream of the registration roller pair 270 or the downstream conveyance unit positioned downstream of the secondary transfer portion 218. Therefore, in order to reduce the color misalignment caused by fluctuation of conveyance speed of the intermediate transfer belt 216, it is effective to suppress fluctuation of force acting on the secondary transfer portion 218 from the sheet while considering the positional relationship between the sheet and the upstream conveyance unit or the downstream conveyance unit.

Control of Conveyance Speed

Next, a method for controlling conveyance speed in which the registration roller pair 270 conveys sheets will be described. The conveyance speed (i.e., sheet conveyance speed) of the registration roller pair 270 refers to the peripheral speed of the roller constituting the registration roller pair 270, especially the peripheral speed of the driving roller connected to the registration motor M3 and driven to rotate. In the present embodiment, the conveyance speed of the registration roller pair 270 is changed during conveyance of the sheet to suppress fluctuation of conveyance speed of the intermediate transfer belt 216 by the force acting on the secondary transfer portion 218 from the sheet, and to reduce color misalignment caused by sheets.

As described above, in order to reduce color misalignment caused by the sheet, it is considered effective to reduce the fluctuation of force acting on the secondary transfer portion 218 from the sheet. Now, as described with reference to FIG. 10, according to the present embodiment, the driving torque of the image forming motor M4 (FIG. 17) during the period in which the sheet passes through the secondary transfer portion 218, i.e., the pass-through section of the secondary transfer portion, tends to be greater than the period during which the sheet is not passed through the secondary transfer portion 218. When driving torque of the image forming motor M4 is increased, it means that load is applied to the secondary transfer portion through the sheet, that is, the intermediate transfer belt 216 and the secondary transfer roller 217 receive force directed toward the upstream direction in the conveyance direction from the sheet.

Thereby, according to the present embodiment, in the pass-through section of the secondary transfer portion, the conveyance speed of the registration roller pair 270 arranged upstream in the secondary transfer portion 218 is increased compared to the speed before the sheet arrives at the secondary transfer portion, to thereby reduce the load applied from the sheet to the secondary transfer portion. Thereby, not only the conveyance force (F1) of the registration roller pair 270 is increased, but also the amount of warping of the recording material formed in the conveyance path between the registration roller pair 270 and the secondary transfer portion 218 is increased, and reaction force F2 caused by stiffness of the sheet is increased. As a result, the force in the direction pressing the sheet toward the secondary transfer portion 218, that is, the force acting in the downstream direction in the conveyance direction is increased.

According further to the present embodiment, the conveyance speed of the registration roller pair 270 is also changed while the sheet passes through the pass-through section of the secondary transfer portion. In this case, the conveyance speed should preferably be changed at a timing at which the leading edge of the sheet enters the respective conveyance members arranged on the conveyance path, or at a timing at which the trailing edge of the sheet passes therethrough. This is because the force acting on the secondary transfer portion 218 from the sheet tends to be changed at these timings, as described earlier. Note that, regarding a timing of changing the conveyance speed of the registration roller pair 270, "a timing corresponding to the leading edge or the trailing edge of the sheet passing a certain point on the conveyance path" means a substantially same timing as the exact timing at which the leading edge or the trailing edge of the sheet passes that point. For example, a timing at which the leading edge of the sheet is located within a nip width of a conveyance roller pair (i.e., within an area in the conveyance direction where the outer surfaces of the rollers are in contact with each other) is a timing corresponding to the leading edge of the sheet entering the conveyance roller pair.

The results of performing speed control of the registration roller pair 270 from the viewpoint described above will be described with reference to FIGS. 11 to 16.

Figure 11:
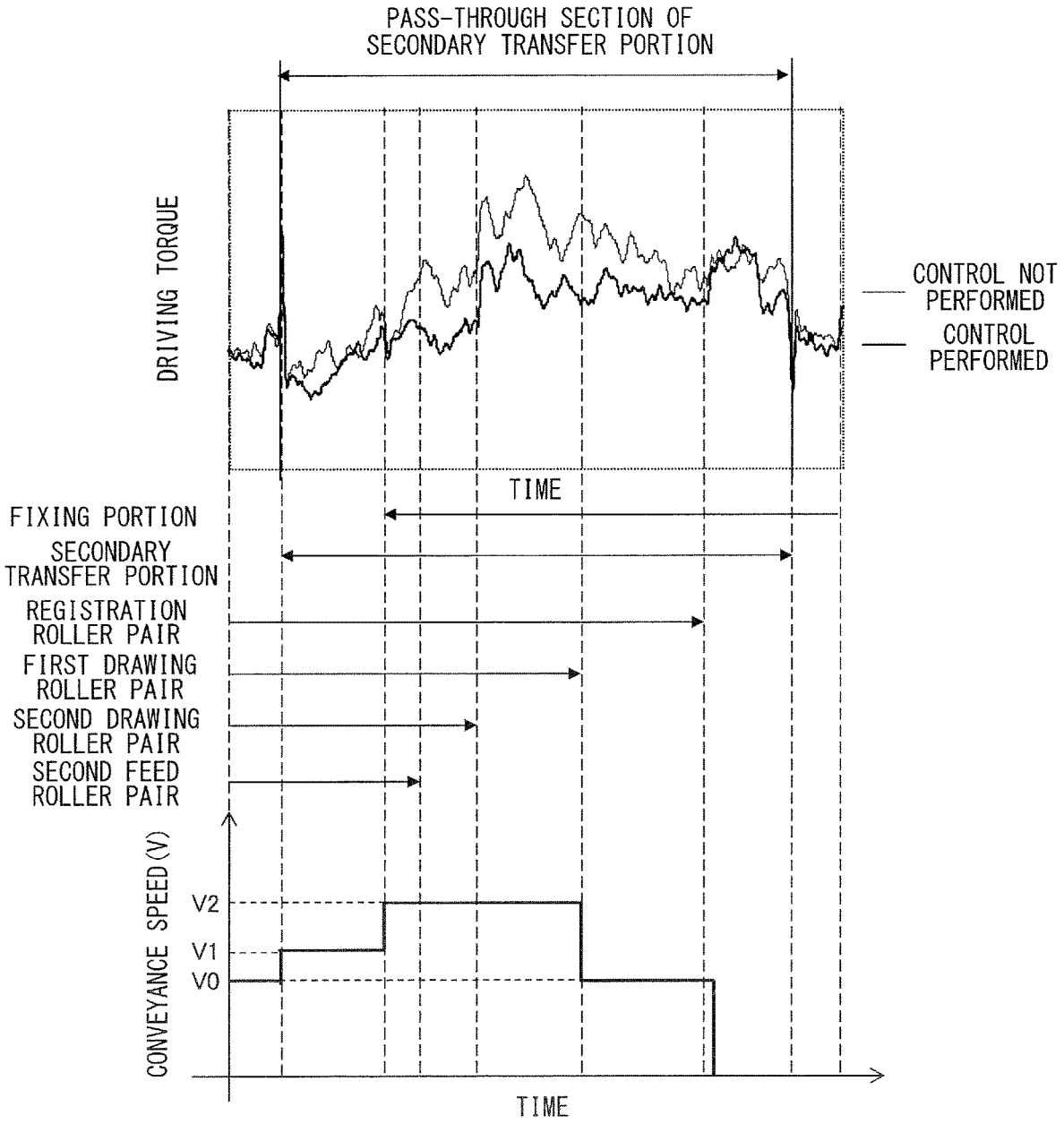
FIG. 11 is a view illustrating an example of speed control sequence in the case of Thick Paper 1 according to the first embodiment.

FIG. 11 illustrates a relationship between driving torque fluctuation (upper portion) and speed control sequence (lower portion) of the registration roller pair 270 in a state where Thick Paper 1 is fed from the second feeding portion 232. The speed control sequence of the registration roller pair 270 is represented by converting a signal value entered as target rotational speed of the motor to a drive circuit that controls rotation of a registration motor M3 serving as a driving source of the registration roller pair 270 to conveyance speed of the registration roller pair 270. Therefore, "changing conveyance speed of the registration roller pair 270" through speed control is realized by a process of changing the target rotational speed of the registration motor M3. The actual conveyance speed of the registration roller pair 270 may be displaced from the value designated by the speed control sequence, but the current and voltage supplied from the drive circuit to the registration motor M3 is controlled so that the actual conveyance speed of the registration roller pair is matched with the value indicated in the speed control sequence.

In the control example illustrated in FIG. 11, when the leading edge of the sheet enters the secondary transfer portion 218, the conveyance speed of the registration roller pair 270 is switched to speed $V_1$ which is faster than speed $V_0$ before entry. The speed $V_0$ which is the speed before the leading edge of the sheet enters the secondary transfer portion 218 is set, for example, to the rotational speed, also referred to as processing speed, of the intermediate transfer belt 216 in the secondary transfer portion 218. Further, when the leading edge of the sheet enters the fixing portion 220, the conveyance speed of the registration roller pair 270 is switched to $V_2$ which is even faster than $V_1$. Thereafter, before the trailing edge of the sheet passes through the first drawing roller pair 261, the conveyance speed of the registration roller pair 270 is returned to $V_0$. After the trailing edge of the sheet passes through the registration roller pair 270, the driving of the registration roller pair 270 is stopped to perform skew correction of a following sheet (V=0). Further according to this control example, the conveyance speed of the registration roller pair 270 will not be changed at other timings at which the leading edge or the trailing edge of the sheet passes the conveyance members, such as at a timing at which the trailing edge of the sheet passes through the second drawing roller pair 262.

The upper portion of FIG. 11 illustrates a driving torque fluctuation of the image forming motor M4 in a case where such speed control is performed by a thick solid line (control performed). Further, it illustrates a driving torque fluctuation in a case where speed control is not performed by a thin solid line (control not performed), in a state where conveyance speed V is set to $V_0$ (fixed value) at the pass-through section of the secondary transfer portion, similar to the case of the "thick paper" in FIG. 10. As can be recognized from the graph, by performing speed control of the registration roller pair 270, fluctuation of driving torque of the image forming motor M4 at the pass-through section of the secondary transfer portion is suppressed. In other words, it has been confirmed that fluctuation of conveyance speed of the intermediate transfer belt 216 can be suppressed by performing appropriate speed control of the registration roller pair 270. The suppressed amount of fluctuation of driving torque of the image forming motor M4 at the pass-through section of the secondary transfer portion can be evaluated by the following perspective, for example.

Fluctuation is suppressed if the average value of absolute value of difference between the driving torque at the pass-through section of the secondary transfer portion and average value of driving torque in a state where a sheet is not passed through the secondary transfer portion is small.

Evaluation criteria on whether fluctuation of driving torque of the image forming motor M4 has been suppressed is not limited to the above-described example, and for example, the "average value" mentioned above can be replaced with "maximum value". The evaluation criteria of evaluating whether fluctuation of driving torque of the image forming motor M4 has been suppressed is necessary for determining an appropriate speed control sequence according to size and type of the sheet, as mentioned later.

Figure 12:
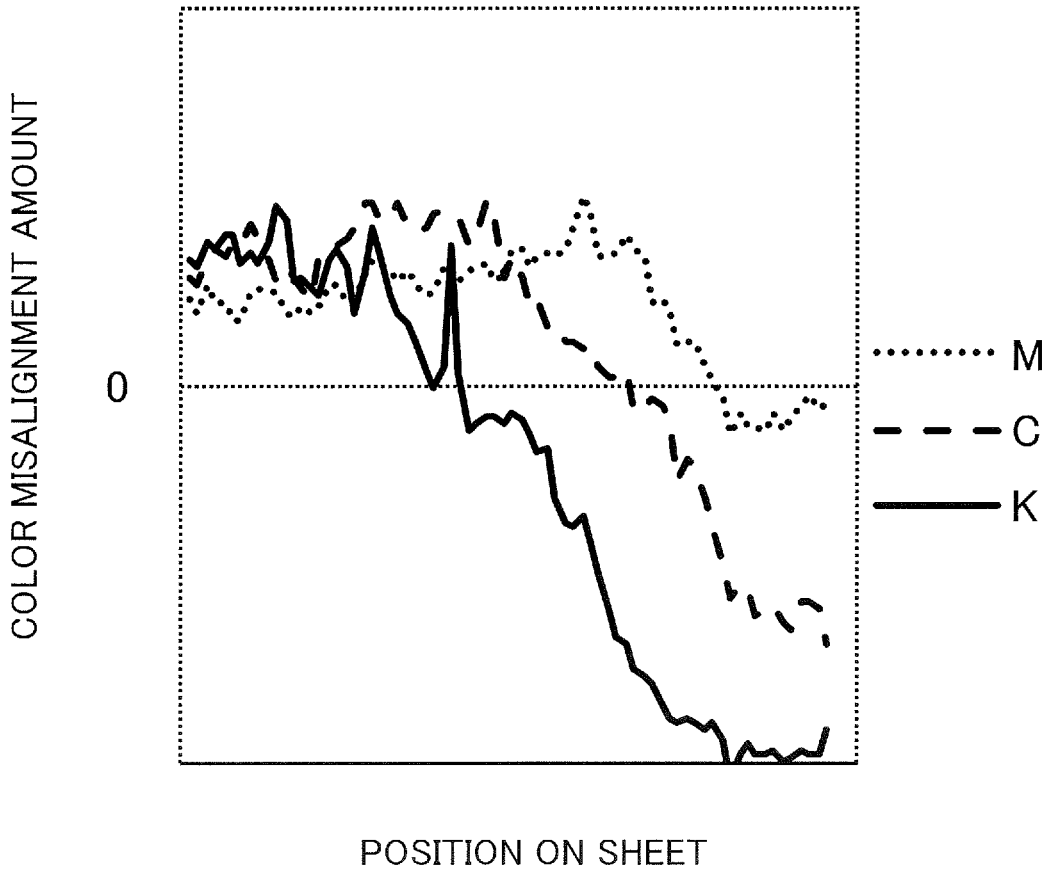
FIG. 12 is a color misalignment waveform of a case where speed control according to the first embodiment is not performed in the case of Thick Paper 1.
Figure 13:
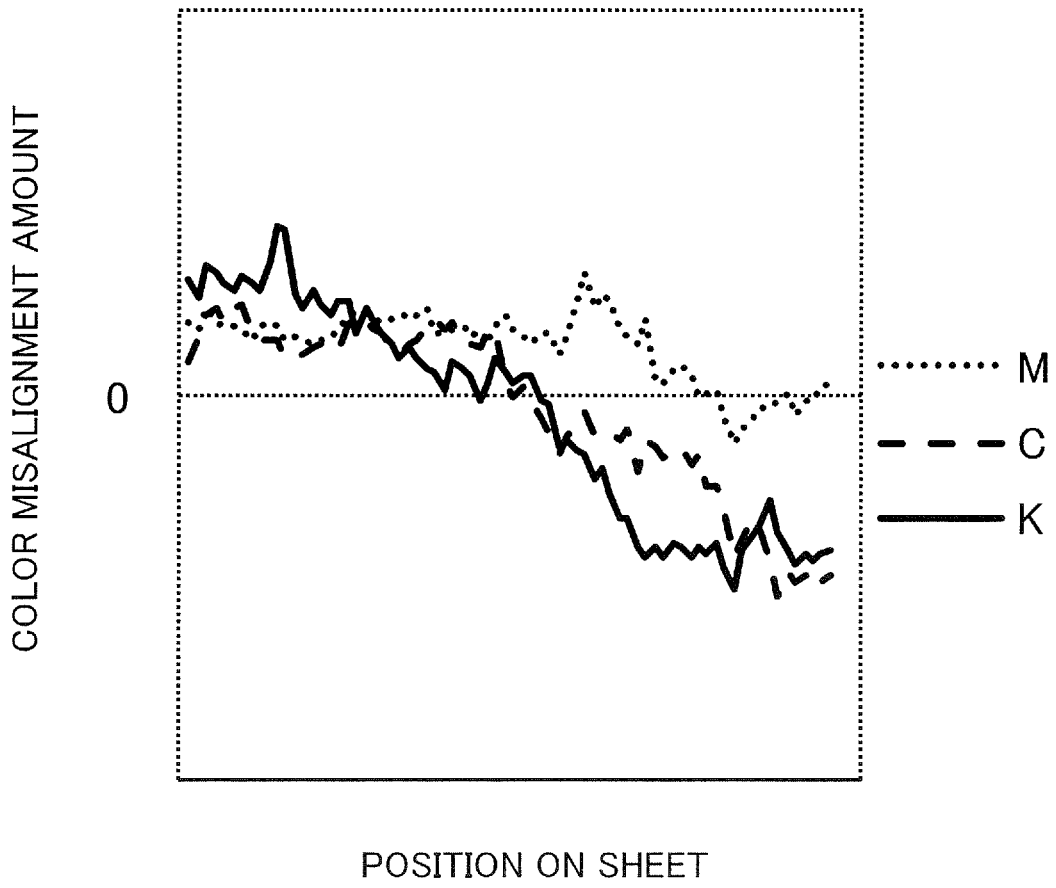
FIG. 13 is a color misalignment waveform of a case where speed control according to the first embodiment is performed in the case of Thick Paper 1.

FIG. 12 illustrates a color misalignment waveform of a case where speed control is not performed, and FIG. 13 illustrates a color misalignment waveform of a case where speed control is performed. Both figures illustrate the result of the color misalignment waveform acquired using a sheet having a same size and grammage, that is, Thick Paper 1. By comparing FIGS. 12 and 13, it can be recognized that color misalignment has been reduced by performing speed control of the registration roller pair 270. Color misalignment reduction is considered to have been realized by suppressing the fluctuation of conveyance speed of the intermediate transfer belt 216 by speed control.

Figure 14:
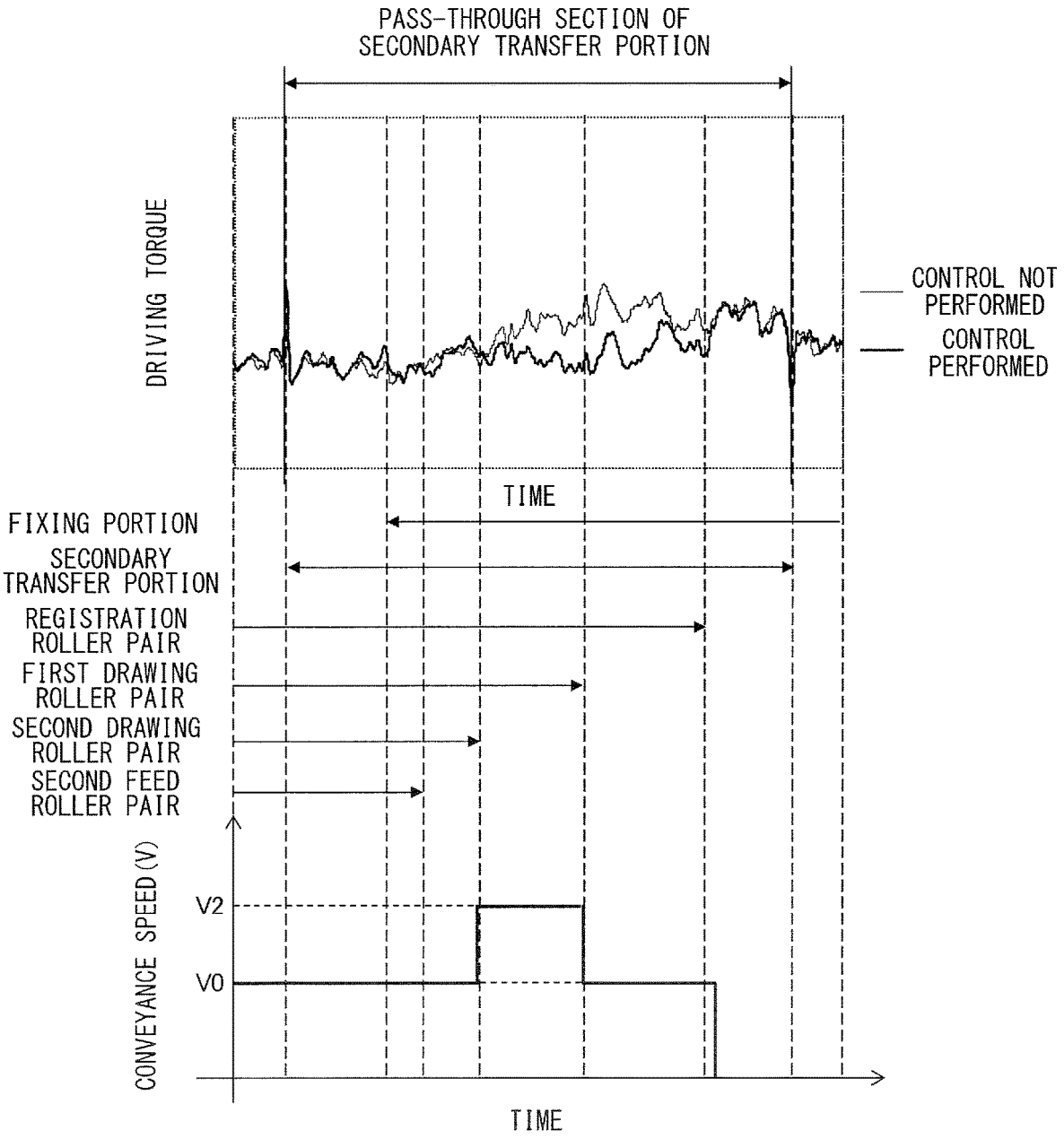
FIG. 14 is a view illustrating another example of speed control sequence in the case of Thick Paper 2 according to the first embodiment.

Next, FIG. 14 illustrates the relationship between driving torque fluctuation of the image forming motor M4 (upper portion) and speed control sequence of the registration roller pair 270 (lower portion) of a state where "Thick Paper 2" is similarly fed from the second feeding portion 232. Thick Paper 2 has smaller grammage than Thick Paper 1 and greater grammage than plain paper. In the example, driving torque fluctuation and speed control sequence of a sheet of Thick Paper 2 having an A3 size that has a length of 420 mm in the conveyance direction is illustrated.

In the speed control sequence of a sheet of Thick Paper 2, the conveyance speed of the registration roller pair 270 is switched to speed $V_2$ which is faster than the previous speed $V_0$ when the trailing edge of the sheet passes through the second drawing roller pair 262, and thereafter, the speed is returned to $V_0$ when the trailing edge of the sheet passes through the first drawing roller pair 261. The upper portion of FIG. 14 illustrates the driving torque fluctuation of the image forming motor M4 of a case where such speed control is performed by a thick solid line (control performed), and illustrates the driving torque fluctuation of a case where such speed control is not performed, that is, in a state where conveyance speed V is set to $V_0$ (fixed value), by a thin solid line (control not performed).

The speed control sequence of Thick Paper 2 (FIG. 14) differs from the speed control sequence of Thick Paper 1 (FIG. 11) in that the forces acting on the secondary transfer portion 218 from the sheet differ mainly due to the difference in stiffness of the sheet. That is, by comparing the graphs on the upper portion of FIGS. 11 and 14 of "control not performed" (thin solid line), it can be recognized that the increase of driving torque of the image forming motor M4 is suppressed in the case where Thick Paper 2 is conveyed compared to the case where Thick Paper 1 is conveyed. In the case of Thick Paper 1, the driving torque has a tendency to increase in the period of time from entry of leading edge of the sheet to the secondary transfer portion 218 to the passing of the trailing edge of the sheet through the second feed roller pair 252, whereas in the case of Thick Paper 2, no significant increase of driving torque can be seen in the same period.

If the sheet of Thick Paper 2 is conveyed without performing speed control of the registration roller pair 270, the period during which increase of driving torque can be observed is from the passing of the trailing edge of the sheet through the second drawing roller pair 262 to the passing of the trailing edge of the sheet through the first drawing roller pair 261. Therefore, as illustrated in the lower part of FIG. 14, during speed control sequence of Thick Paper 2, conveyance speed of the registration roller pair 270 is increased only during the corresponding period. As illustrated in the upper part of FIG. 14, it has been confirmed that driving torque fluctuation can be suppressed effectively by performing such speed control. That is, by varying the speed control sequence of the registration roller pair 270 according to a sheet type of the sheet, fluctuation of force acting on the secondary transfer portion 218 from the sheet can be suppressed effectively in the pass-through section of the secondary transfer portion 218.

Figure 15:
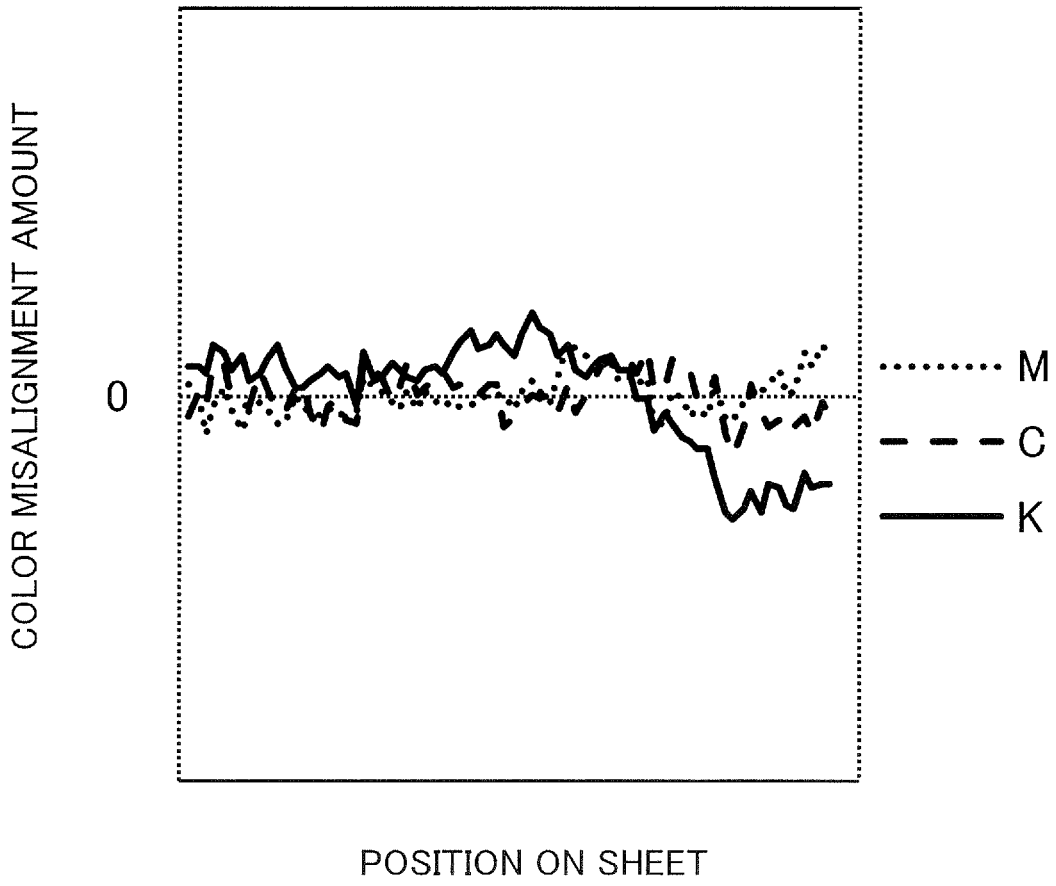
FIG. 15 is a color misalignment waveform of a case where speed control according to the first embodiment is not performed in the case of Thick Paper 2.
Figure 16:
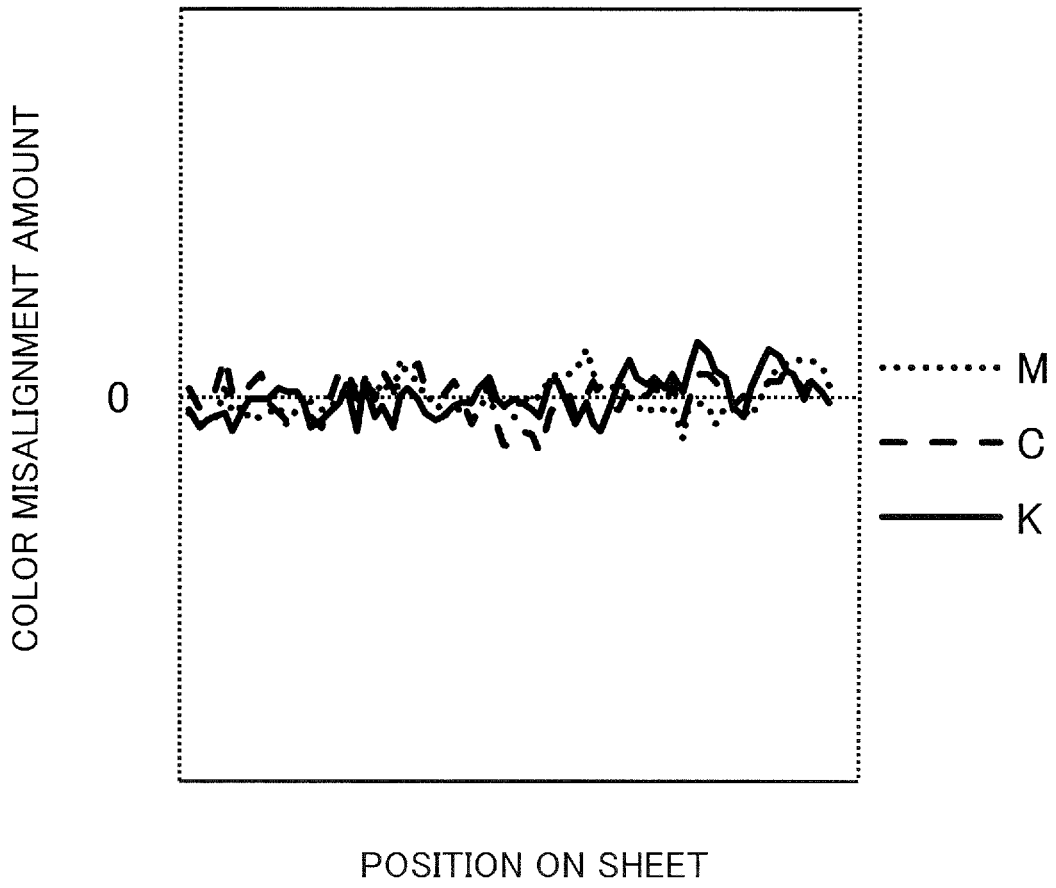
FIG. 16 is a color misalignment waveform of a case where speed control according to the first embodiment is performed in the case of Thick Paper 2.

FIG. 15 illustrates a color misalignment waveform of a case where speed control is not performed, and FIG. 16 illustrates a color misalignment waveform of a case where speed control is performed. Both figures illustrate the result of the color misalignment waveform acquired using a sheet having a same size and grammage, that is, Thick Paper 2. Though the level of color misalignment caused by the sheet is smaller for Thick Paper 2 than Thick Paper 1, by comparing FIGS. 15 and 16, it can be recognized that the color misalignment has been reduced by performing speed control of the registration roller pair 270. This is considered to have been realized by suppressing of fluctuation of conveyance speed of the intermediate transfer belt 216 by speed control.

As described, color misalignment can be reduced by changing the conveyance speed of the registration roller pair 270 during the period when the sheet passes through the secondary transfer portion 218. The timing of entry of the leading edge of the sheet to respective conveyance members on the conveyance path or the timing of passing of the trailing edge therethrough are appropriate as the timing for changing conveyance speed of the registration roller pair 270. Further, since the driving torque acting on the image forming motor M4 shows various fluctuations depending on the size and physical property of the sheet, it is preferable to change the speed control sequence defining the changing timing and value of the conveyance speed of the registration roller pair 270 according to the physical property of the sheet. The physical property of a sheet refers, for example, to stiffness, weight of the sheet itself, and surface property that influences sliding friction with the conveyance guide. FIGS. 11 to 16 illustrate speed control sequences for two types of sheets having different grammages, that are Thick Paper 1 and Thick Paper 2, but it is also preferable to define speed control sequences for other types of sheets.

The order in which the leading edge and the trailing edge of the sheet passes the respective conveyance members in the conveyance path differs, for example, by the sheet size, especially the length of the sheet in the conveyance direction, and the position of the sheet feed portion serving as feed source. Therefore, the speed control sequence should preferably be varied according to such conditions.

Control Method

Next, a control method of the image forming apparatus 201 according to the present embodiment will be described.

Figure 17:
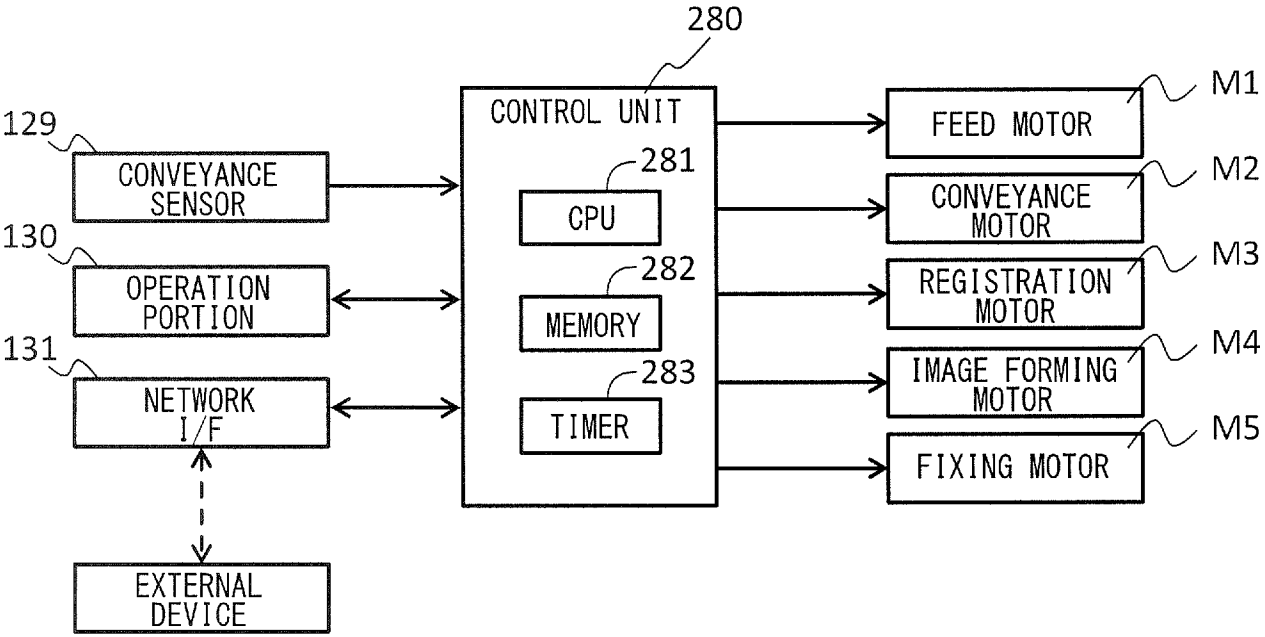
FIG. 17 is a block diagram illustrating a control structure of the image forming apparatus according to the first embodiment.

FIG. 17 is a block diagram illustrating a control structure of the image forming apparatus 201. The control unit 280 which serves as a controller according to the present embodiment is provided in the apparatus body of the image forming apparatus 201. The control unit 280 includes a Central Processing Unit (CPU) 281, a memory 282, and a timer 283. The CPU 281 reads and executes programs stored in the memory 282, and controls operation of the image forming apparatus 201. The memory 282 includes a volatile storage device and a nonvolatile storage device and serves both as storage location of programs and data and as workspace when the CPU 281 executes programs. The memory 282 is an example of a non-transitory computer-readable storage medium that stores programs for controlling the image forming apparatus 201 by the control method described hereafter. The timer 283 can utilize the function of a hardware timer such as a real-time clock or a function of an interval timer included in the program, or a combination thereof.

The control unit 280 sends command signals to the drive circuit of various motors (M1 to M5) described above and gives orders to start or stop rotation of various motors or designates rotation speeds thereof. Further, the control unit 280 is connected to a conveyance sensor 129 or an operation portion 130 provided in the image forming apparatus 201 and it is further connectable to external device such as personal computers and portable information devices through a network interface (I/F) 131. If a job information including image information is received from an external device, for example, the control unit 280 executes a series of operations, such as a print job, of feeding a sheet from one of the sheet feeding portions and forming an image on the sheet by the image forming portion.

The conveyance sensor 129 is a sensor that is used to monitor the conveyance of sheets in the image forming apparatus 201. The conveyance sensor 129 is arranged at a plurality of positions on the sheet conveyance path, and it is designed to output different detection signals based on whether a sheet is detected or not. A photo-interrupter that detects a flag that contacts the sheet and swings or a photo-reflector that detects reflected light from the sheet can be used as the conveyance sensor 129. The control unit 280 refers to the detection signal of the conveyance sensor 129 to confirm whether the leading edge or the trailing edge of the sheet has passed the detection position of each sensor, and to specify the current positional relationship between the sheet and the respective conveyance members on the conveyance path. For example, based on the detection signal from the conveyance sensor 129 provided close to the upstream side of the registration roller pair 270 in the sheet conveyance direction, the control unit 280 can specify the time at which the leading edge of the sheet enters the registration roller pair 270 or the time at which the trailing edge of the sheet passes through the registration roller pair 270.

The operation portion 130 is a user interface of the image forming apparatus 201, and it includes a display device such as a liquid crystal panel, and an input device such as a numeric keypad, a print start button and a touch panel function unit on the liquid crystal panel. The operation portion 130 provides setting information, such as the size and type of the sheets stored in each cassette, to the user through the display device, and receives operation from the user through the input device. The control unit 280 orders the contents of display on the operation portion 130, changes the setting information based on the operation of the user, and stores the changed setting information in the memory 282.

In other words, the control unit 280 can acquire information related to the sheet size and sheet type used for forming the image based on the operation of the user using the operation portion 130. However, the unit through which the control unit 280 acquires information on sheets is not limited to the operation portion 130, and for example, the sheet size can be detected automatically using a sensor provided on the cassettes. Further, if information designating sheet type is included in the job information received from the external device, the control unit 280 may analyze the job information and store the designated sheet type as the sheet type used for the current print job.

Next, a control method of the image forming apparatus according to the present embodiment will be described using the flowchart illustrated in FIG. 18. The respective processes of the flowchart are implemented by the CPU 281 of the control unit 280 executing a program.

At first, in a state where the control unit 280 receives a print job (S1), the control unit 280 checks the setting of the sheet designated in the received job (S2). The setting of the sheet is a setting value indicating sheet type set by the user, such as a grammage classification of the sheet, for example "grammage of 64 to 75 g/m$^2$", and information specifying the feeding portion serving as the feeding source, for example, "the second cassette 242". In a state where the sheet size is designated in the received job, the control unit 280 acquires the sheet size used for the print job, for example, an A3 size of 297 mm×420 mm, by analyzing the received job information. In a state where the sheet size is not designated, the sheet size used for the print job is acquired by detecting the size stored for the respective cassettes through the operation portion 130 or the sensors provided on the cassettes.

Grammage classification of the sheet is used as the set value indicating the sheet type, since in many cases it is clearly indicated on a sheet package, and it is widely adopted as the setting related to the sheet type in the image forming apparatus. Further, the grammage classification of the sheet is a set value that is correlated with the force that acts on the secondary transfer portion 218 from the sheet. However, it is possible to adopt a configuration where information correlated with the level of force acting on the secondary transfer portion 218 from the sheet is requested, such as information related to the stiffness of the sheet, as the setting of the sheet, and the sheet type is determined based on the entered information. Further, in a configuration that enables input of brand name of the sheet, it is possible to determine the sheet type by referring to a correspondence table of the brane name and the grammage, or stiffness, stored in the memory 282.

After checking the setting of the sheet, the control unit 280 refers to the speed control sequence corresponding to the acquired sheet setting from the speed control sequences stored in the memory 282 (S3), and starts the image forming operation by the image forming portion 201B and sheet feeding operation (S4).

Figure 19:
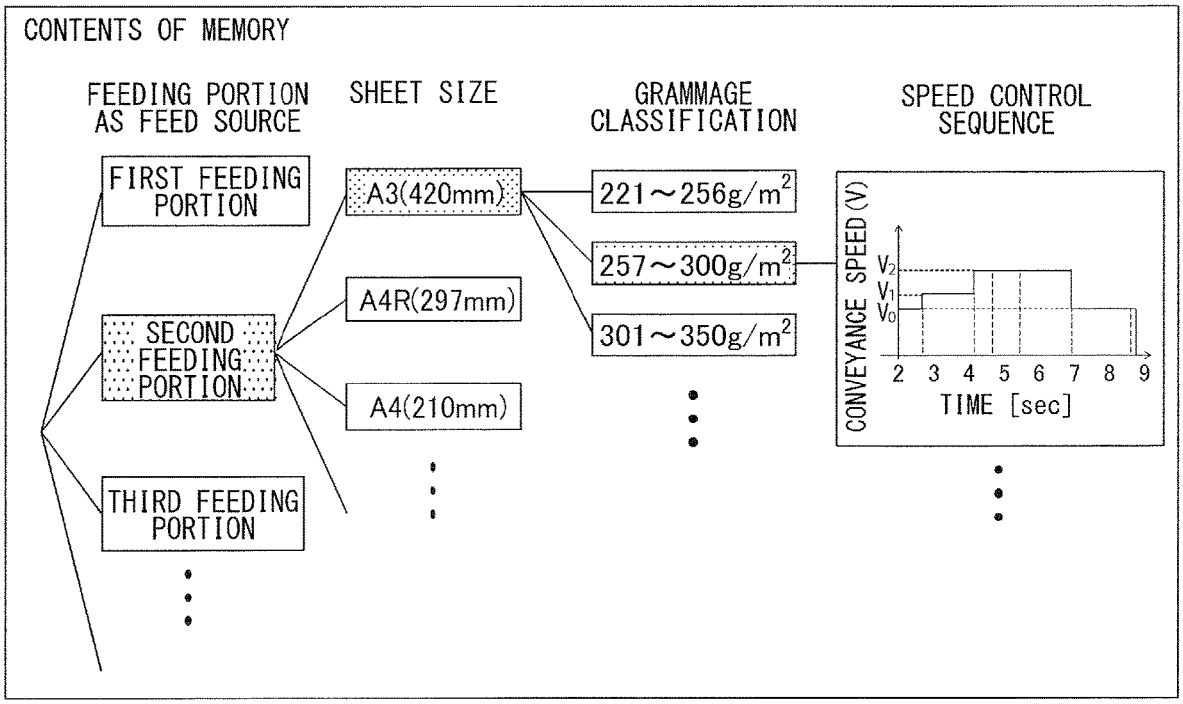
FIG. 19 is a schematic diagram illustrating a data structure of speed control sequence according to the first embodiment.

FIG. 19 is a schematic diagram illustrating a data structure of speed control sequence stored in the memory 282. In the present embodiment, speed control sequences for various combinations of the following three conditions, which are the sheet feeding portion serving as a feed source, the size or conveyance direction length of the sheet, and the grammage classification, are prepared in advance and stored in the memory 282. The contents of the speed control sequence should be determined in advance by tests for each of the combination of conditions so as to effectively suppress the driving torque fluctuation of the image forming motor M4. Further, such data of speed control sequences can be stored in the memory 282 in the form of a hash table with the combination of conditions set as key and speed control sequence set as value, for example.

If the leading edge of the sheet fed from the feeding portion serving as the feeding source reaches the registration roller pair 270, the control unit 280 stops feeding the sheet and keeps the sheet to stand by at the registration roller pair 270 (S5). Next, at a matched timing with the writing of image at the image forming portion 201B, the control unit 280 starts to drive the registration roller pair 270 according to a speed control sequence referred to in the memory 282 (S6). Image writing timing refers to the timing at which transmission of a signal, i.e., video signal, for ordering the laser scanner 210 to write the electrostatic latent image is started. After the image writing timing, usually the sheet is conveyed without being stopped at least until the fixing process is completed, so the image writing timing is appropriate as a start reference time of the speed control sequence.

In S6, the drive of the registration roller pair 270 is started to send the sheet to the secondary transfer portion 218, and thereafter, the sheet passes the fixing portion 220 where image is transferred and fixed to the sheet. After the trailing edge of the sheet passes through the registration roller pair 270, the driving of the registration roller pair 270 is stopped before the leading edge of the following sheet reaches the registration roller pair 270 (S7). If a page yet to be printed exists, the processes of S5 to S8 are repeated. If printing of all pages included in the print job is completed, the print job is ended (S8).

Summary of Present Embodiment

According to the present embodiment, as described above, the conveyance speed of the registration roller pair 270 is varied after the leading edge of the sheet has entered the secondary transfer portion 218 and before the trailing edge of the sheet passes through the registration roller pair 270, so that fluctuation of force acting on the secondary transfer portion 218 from the sheet is suppressed. Thereby, fluctuation of conveyance speed of the intermediate transfer belt 216 is reduced, and the color misalignment caused by sheets can be reduced. As the timing for changing the conveyance speed, a timing at which the leading edge or the trailing edge of the sheet passes the respective conveyance members on the conveyance path is preferable, as described above.

The configuration of the present embodiment is especially effective in a case where the driving torque fluctuation of the image forming motor M4 is high when the trailing edge of the sheet passes through the conveyance member upstream of the registration roller pair 270, for example, the second drawing roller pair 262 in a case where a sheet is fed from the second feeding portion 232. In this case, if the speed control according to the present embodiment is applied, the registration roller pair 270 conveys the sheet at a relatively low speed before the trailing edge of the sheet passes through the upstream conveyance member, and the registration roller pair 270 conveys the sheet at a relatively high speed after the trailing edge of the sheet has passed through the upstream conveyance member.

In other words, the conveyance unit conveys the sheet by a first speed before the trailing edge of the sheet passes through the upstream conveyance unit, and after the trailing edge of the sheet passes through the upstream conveyance unit, the conveyance speed of the conveyance unit is changed so that the conveyance unit conveys the sheet by a second speed that is faster than the first speed. For example, in the case of the speed control sequence illustrated in FIG. 14, the example of the upstream conveyance unit is the second drawing roller pair 262, the example of the first speed is $V_0$, and the example of the second speed is $V_2$. Thereby, the fluctuation of force acting on the secondary transfer portion 218 from the sheet at the moment when the trailing edge of the sheet passes through the upstream conveyance unit or the period of time thereafter is suppressed, so that the color misalignment caused by the sheet can be suppressed.

The timing for changing the conveyance speed can be the timing when the trailing edge of the sheet has passed through the upstream conveyance unit, but the timing can be different from the timing at which the trailing edge of the sheet passes through the upstream conveyance unit. For example, according to the speed control sequence illustrated in FIG. 11, the example of the upstream conveyance unit is the second drawing roller pair 262, and the conveyance speed of the registration roller pair 270 is changed from $V_1$, i.e., first speed, to $V_2$, i.e., second speed, at a timing before the trailing edge of the sheet passes through the second drawing roller pair 262. As described, it is also possible to set the conveyance speed of the conveyance unit to the first speed at least at a portion of the period before the trailing edge of the sheet passes through the upstream conveyance unit, and to set the conveyance speed of the conveyance unit to the second speed at least at a portion of the period after the trailing edge of the sheet has passed through the upstream conveyance unit. Even according to this case, the speed difference between the first speed and the second speed is expected to exert an action of suppressing fluctuation of force that acts on the secondary transfer portion 218 from the sheet.

The second speed is a speed faster than the processing speed that serves as the conveyance speed of the sheet at the transfer portion. The first speed can be either a speed equal to or slower than the processing speed, or faster than the processing speed.

Further according to the present embodiment, the contents of the speed control sequence of the registration roller pair 270 can be varied according to the grammage classification of the sheets. For example, if the grammage classification of the sheet is "plain paper" that has smaller grammage than "Thick Paper 1" and "Thick Paper 2", it is possible to set the conveyance speed of the registration roller pair 270 at the pass-through section of the secondary transfer portion to be fixed to $V_0$. Plain paper has even lower stiffness than Thick Paper 2, so that color misalignment caused by force acting on the secondary transfer portion 218 from the sheet does not easily occur even without performing speed control of the registration roller pair 270.

In other words, when conveying a sheet having a first grammage according to the present embodiment, a first mode is executed where the drive unit does not change the driving speed of the conveyance unit between before and after passing of the trailing edge of the sheet through the upstream conveyance unit. According further to the present embodiment, when conveying a sheet having a second grammage that is greater than the first grammage, a second mode is executed where the conveyance speed of the conveyance unit is changed between the first speed and the second speed before and after passing of the trailing edge of the sheet through the upstream conveyance unit. Thereby, it becomes possible to prevent unnecessary change of conveyance speed of the conveyance unit under a condition where color misalignment caused by the sheet does not easily occur, so that the possibility of the sheet being pulled between the conveyance unit and the upstream conveyance unit can be minimized.

Further according to the present embodiment, at a timing when the leading edge of the sheet enters the transfer portion, the conveyance speed of the sheet by the conveyance unit is changed to a faster speed than the speed before the leading edge of the sheet enters the transfer portion (refer to FIG. 11). Thereby, it becomes possible to cancel out the driving torque of the image forming motor M4 that increases when the sheet of Thick Paper 2 having a relatively high thickness enters the secondary transfer portion 218 by the increased speed of the registration roller pair 270, and to suppress fluctuation of rotational speed of the intermediate transfer belt 216 that leads to color misalignment.

The advantage of performing such speed change at a timing where the leading edge of the sheet enters the transfer portion is that fluctuation of rotational speed of the intermediate transfer belt 216 can be suppressed without affecting the positioning of the image in the conveyance direction. Normally, the conveyance operation of the registration roller pair 270 sending a sheet toward the secondary transfer portion 218 is based on the writing timing of image at the image forming portion 201B. Further, the timing at which the leading edge of the sheet enters the secondary transfer portion 218 is set to correspond to the timing at which the leading edge of the toner image borne on the intermediate transfer belt 216 reaches the secondary transfer portion. More specifically, control is performed so that the leading edge of the effective printing area of the sheet corresponds to the leading edge of the area on the intermediate transfer belt 216 corresponding to the effective printing area, that is, the area to which toner is adhered if solid image is to be formed.

Therefore, if the conveyance speed of the registration roller pair 270 is changed with the aim to reduce color misalignment before the leading edge of the sheet enters the transfer portion, there is a concern that the positioning accuracy of the image may be affected. The attempt to maintain the positioning accuracy of the image may require a more complex control, such as changing the timing to start driving the registration roller pair 270. Meanwhile, according to the present embodiment, speed change of the registration roller pair 270 is performed at a timing at which the leading edge of the sheet enters the transfer portion, so that it becomes possible to suppress fluctuation of rotational speed of the intermediate transfer belt 216 that may lead to color misalignment while avoiding such drawbacks.

A method to perform speed control of the registration roller pair 270 based on the timing at which the leading edge of the sheet is detected using a sensor without stopping the leading edge of the sheet, i.e., active registration, is known as a method to performing positioning of the image by the registration roller pair 270. Generally, in the active registration system, precise control of the conveyance speed of the registration roller pair 270 is required before the leading edge of the sheet enters the transfer portion. Therefore, if the conveyance speed of the registration roller pair 270 is changed to suppress speed fluctuation of the intermediate transfer belt 216 by the entry of the sheet in the transfer portion, it is especially preferable to perform speed change at a timing when the leading edge of the sheet enters the transfer portion.

Second Embodiment

Next, an image forming apparatus according to a second embodiment will be described. In the present embodiment, the method for preparing speed control sequence of the registration roller pair 270 differs from the first embodiment, but the mechanical configurations and the like of the image forming apparatus are the same as the first embodiment. In the following description, components having a similar configuration and function as the first embodiment are denoted with the same reference numbers, and descriptions thereof are omitted.

According to the present embodiment, the speed control sequence is not determined in advance for each sheet size and stored in the memory 282, as according to the first embodiment, but instead, a speed control sequence is generated each time based on the sheet size and the like. According to the present method, speed control for effectively reducing color misalignment according to sheet size can be executed even according to a mode for feeding a sheet having a size that does not correspond to normal sheet sizes.

In the present embodiment, according to the size, that is, conveyance direction length, of the sheet used in the print job and the position of the feeding portion of the feed source, the timing at which the leading edge or the trailing edge of the sheet passes the respective conveyance members on the conveyance path, hereinafter called conveyance timing, is calculated. Based on this conveyance timing and a set value indicating sheet type used in the print job, the speed control sequence is created.

Hereafter, a method of how speed control sequence is determined in a case where a sheet of A3-size Thick Paper 1 with a conveyance direction length of 420 mm is fed from the second feeding portion 232 is described as a specific example. For simplification, the length of the time during which the leading edge of the sheet stands by at the registration roller pair 270 is set to zero.

At first, a conveyance timing according to the above-described conditions is calculated. A conveyance path for feeding the sheet from the second feeding portion 232 is configured of the fixing portion 220, the secondary transfer portion 218, the registration roller pair 270, the first drawing roller pair 261, the second drawing roller pair 262 and the second feed roller pair 252 in the named order, from the downstream side in the conveyance direction, as illustrated in FIG. 2. In the description, the positions of the components in the conveyance path are referred to as $Y_1$, $Y_2$, $Y_3$, $Y_{4a}$, $Y_{5a}$ and $Y_{5b}$, in the named order. The downstream side in the conveyance direction is referred to as the positive direction, so that the following relationship is satisfied: $Y_1>Y_2>Y_3>Y_{4a}>Y_{5a}>Y_{5b}$. The time at which the leading edge of the sheet enters the respective conveyance members are respectively referred to as $T_{i1}$, $T_{i2}$, $T_{i3}$, $T_{i4a}$, $T_{i5a}$ and $T_{i5b}$, in the named order, and the time at which the trailing edge of the sheet passes through the respective conveyance members are referred to as $T_{o1}$, $T_{o2}$, $T_{o3}$, $T_{o4a}$, $T_{o5a}$ and $T_{o5b}$, in the named order. In this case, the values of the respective time $T_{ij}$ and $T_{oj}$ (j={1, 2, 3, 4a, 5a, 5b}) can be computed using the following Expressions 1 and 2. Note that L is a length of the sheet in the conveyance direction, and V is a conveyance speed of the registration roller pair 270. When calculating the conveyance timing, it may be possible to perform calculation assuming that V is fixed to $V_0$ for simplification.

Expression 1

$$T_{ij} = \frac{Y_j}{V} \quad (j = \{1, 2, 3, 4a, 5a, 5b\}) \tag{1}$$

Expression 2

$$T_{oj} = \frac{(Y_j + L)}{V} \quad (j = \{1, 2, 3, 4a, 5a, 5b\}) \tag{2}$$

Figure 20:
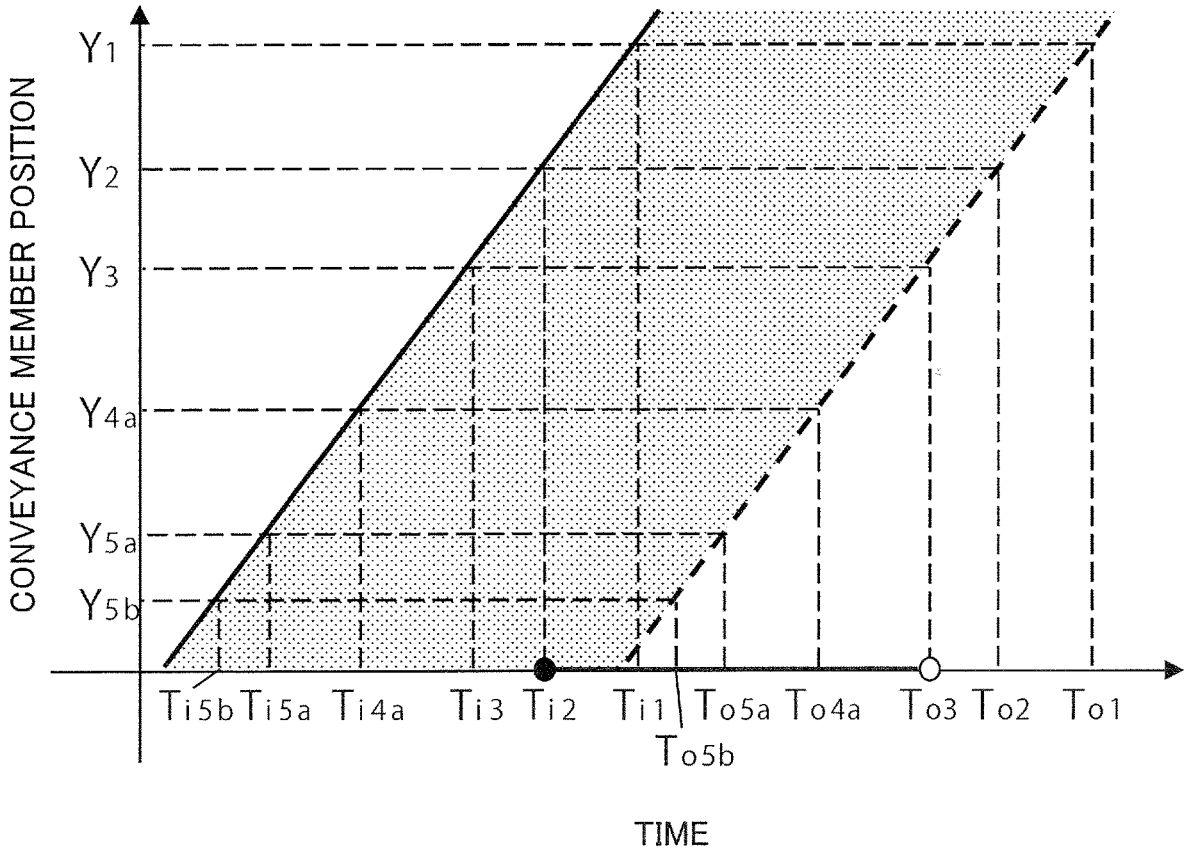
FIG. 20 is a diagram illustrating a change of position of a sheet on a conveyance path according to a second embodiment, in a case where an A3-size sheet is fed from a second feeding portion.

FIG. 20 is a diagram illustrating a position of a sheet in a conveyance path in a case where an A3-size sheet is fed from the second feeding portion 232, wherein the vertical axis represents a position in the conveyance path and the horizontal axis represents time. A thick solid line in the graph represents a position of a leading edge of the sheet at that time, a thick dashed line represents a position of a trailing edge thereof, and a filled area represents a sheet passing area. FIG. 20 shows that $T_{i1}<T_{o5b}$, and it can be recognized that the trailing edge of the sheet has passed through the second feed roller pair 252 after the leading edge of the sheet has entered the fixing portion 220.

Now, the time during which the force acting on the secondary transfer portion 218 from the sheet by speed control of the registration roller pair 270 is the period during which the sheet is nipped both by the registration roller pair 270 and the secondary transfer portion 218. In other words, the period from entry of the leading edge of the sheet to the secondary transfer portion 218 to passing of the trailing edge of the sheet through the registration roller pair 270 ($T_{i2} \leq T \leq T_{o3}$) is the period during which speed control of the registration roller pair 270 is effective in reducing the color misalignment caused by the sheet. This period is illustrated as the section from the black dot to the white dot on the horizontal axis of FIG. 20.

Next, in addition to the calculated conveyance timing, speed control sequence is created by referring to a set value of speed stored in the memory. Set value of speed refers to set values of conveyance speed of the registration roller pair 270 separated for each event of conveyance timing, which according to the present condition is as shown in Expression 3.

Expression 3

$$V = \begin{cases} V_0 & (T_{i2} \leq T < T_{i1}) \\ V_1 & (T_{i1} \leq T < T_{i5b}) \\ V_2 & (T_{i5b} \leq T < T_{o5a}) \\ V_2 & (T_{o5a} \leq T < T_{5o4a}) \\ V_2 & (T_{o4a} \leq T < T_{o3}) \\ V_0 & (T_{o3} \leq T < T_{o2}) \end{cases} \tag{3}$$

As shown in Expression 3, the set value of speed according to the present embodiment is allowed to be set to the same values before and after the conveyance timing. This is because the set value of speed is determined for each combination of conveyance timings so that fluctuation of force acting on the secondary transfer portion 218 from the sheet is suppressed at the conveyance section defined by two conveyance timings adjacent one another on a time axis. According to the present embodiment, the set value of speed is selected from a plurality of values, i.e., discretely spread values, including $V_0$, $V_1$ and $V_2$, so that there may be a case where the set value of speed for a certain conveyance section and a set value of speed of a successive conveyance section become the same values. That is, speed change of the registration roller pair 270 is not necessarily performed at all conveyance timings.

Further, the number of values and the level of the values selectable as the set value of speed is not necessarily limited to those illustrated in this embodiment. The reason for this is because the set value of speed is determined to suppress fluctuation of force acting on the secondary transfer portion 218 from the sheet at the respective conveyance sections according to the actual configuration of conveyance path provided in the image forming apparatus.

Figure 21:
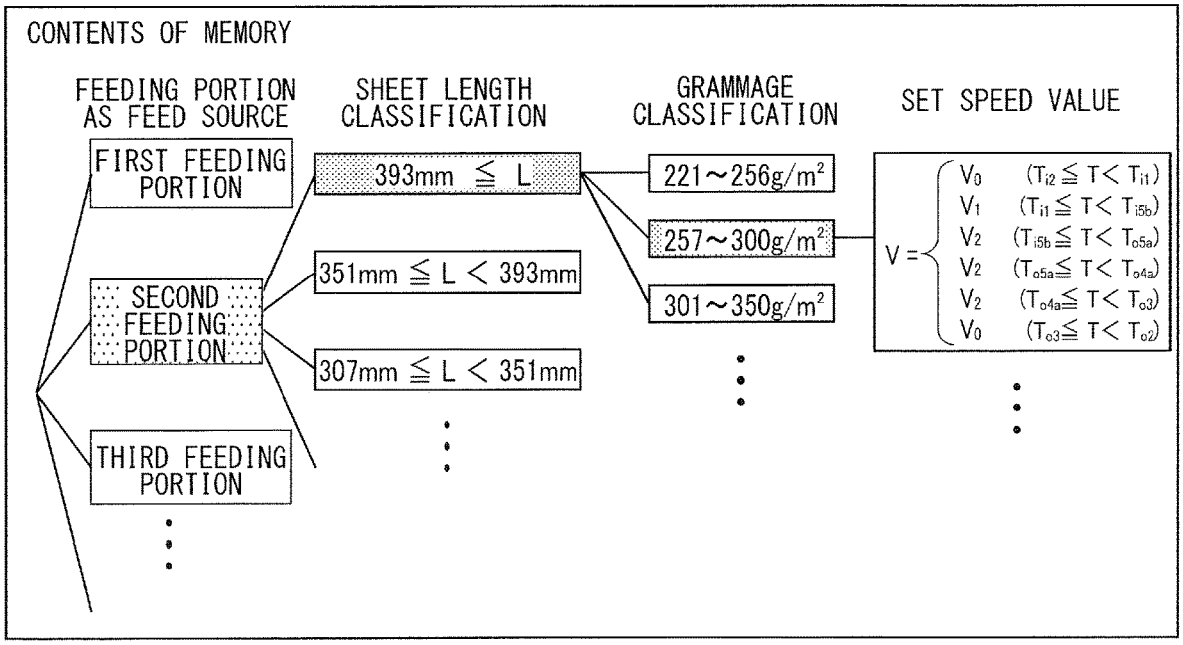
FIG. 21 is a schematic diagram illustrating a data structure of a speed control sequence according to the second embodiment.

As illustrated in FIG. 21, the number of set values of speed stored in the memory corresponds to the number of combinations of the sheet feeding portions of the feed source, classification of length of the sheet in the conveyance direction, and the grammage classification of the sheet set by the user. The conveyance path changes by the change of feed portion of the feed source, and in a state where the grammage classification is changed, the magnitude of force acting on the secondary transfer portion 218 from the sheet when speed control is not performed changes, so that there is a need to similarly change the set value of speed being set. Classification of length of the sheet in the conveyance direction refers to a group related to a length having a fixed width, and if the sheets belong to the same classification of length, it means that the order of respective events at the conveyance timing are the same. If sheets belong to the same classification of length, the tendency of fluctuation of driving torque of the image forming motor M4 in the pass-through section of the secondary transfer portion is similar, so it is considered appropriate to perform speed control by the same set value of speed.

Figure 23:
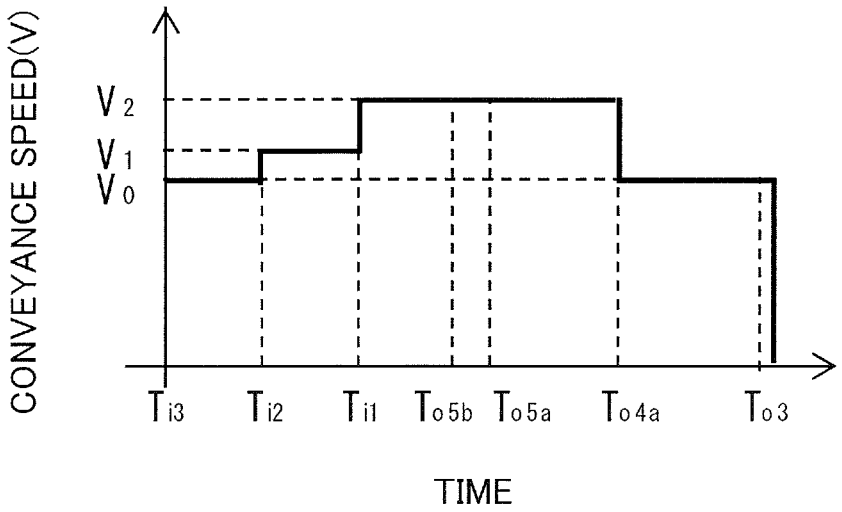
FIG. 23 is a view illustrating an example of a speed control sequence according to the second embodiment, in a case where an A3-size sheet is fed from the second feeding portion.

FIG. 22 illustrates a correspondence of the classification of the sheet length and magnitude correlation of conveyance timing, i.e., correlation of time order, for the sheet fed from the second feeding portion 232. In the present embodiment, if sheet lengths are classified so that the conveyance timing becomes common with respect to the conveyance path of the sheet fed from the second feeding portion 232, there are eight classifications of length of sheets as illustrated in FIG. 22. For example, the length L of A3-size sheet in the conveyance direction is 420 mm, so that the set value No. 1 of speed of FIG. 22 is referred to. The speed control sequence determined in the above-mentioned procedure is illustrated in FIG. 23.

By creating the speed control sequence according to the above-described procedure, appropriate speed control sequence can be applied to a sheet that does not correspond to standard sheet sizes.

Figure 24:
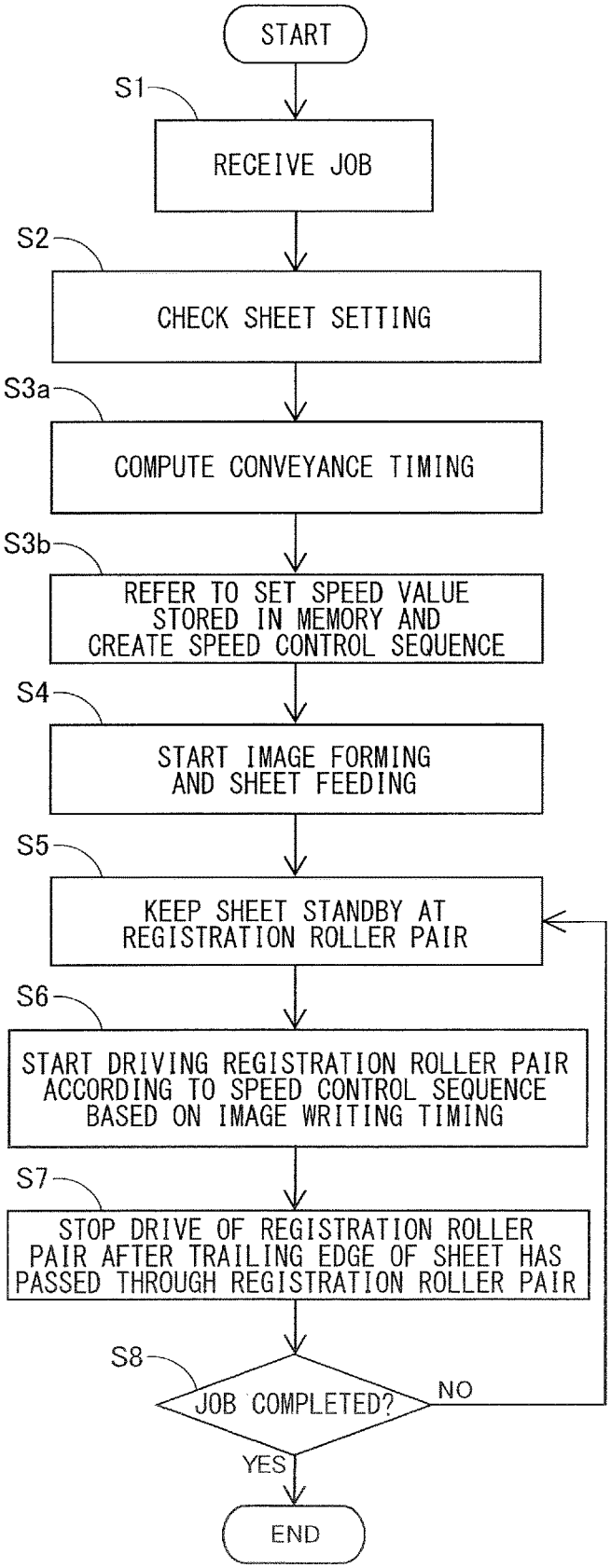
FIG. 24 is a flowchart illustrating a control method of an image forming apparatus according to the second embodiment.

The following is a description of a control method of the image forming apparatus according to the present embodiment with reference to a flowchart illustrated in FIG. 24. The processes of respective steps of the flowchart are performed by the CPU 281 of the control unit 280 executing a program. The present flowchart differs from the flowchart of the first embodiment illustrated in FIG. 18 in that S3 is replaced with S3*a* and S3*b*.

At first, in a state where the control unit 280 receives a print job (S1), the control unit 280 checks the setting of the sheet designated in the received job (S2). After checking the sheet setting, the control unit 280 uses the acquired sheet setting, especially the information related to conveyance direction length L of the sheet and feeding portion of the feed source, and calculates the conveyance timing based on Expressions 1 and 2 (S3*a*). Then, the control unit 280 creates a speed control sequence using the calculated conveyance timing and a set value of speed acquired by referring to the memory 282 based on the sheet setting (S3*b*).

Figure 18:
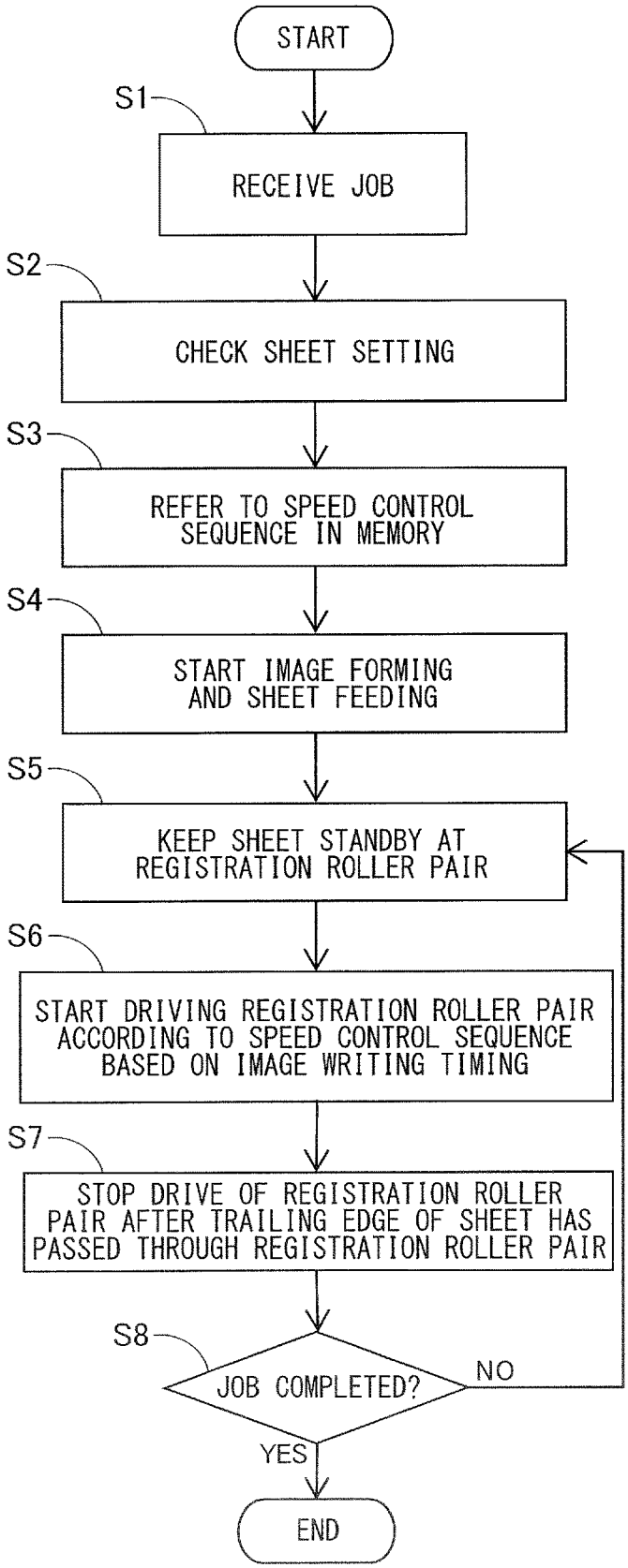
FIG. 18 is a flowchart illustrating a control method of an image forming apparatus according to the first embodiment.

The following steps S4 to S8 are similar to those in the procedure described in the first embodiment (FIG. 18). That is, after starting image forming operation by the image forming portion 201B and sheet feeding operation (S4), the control unit 280 causes the sheet to stand-by at the registration roller pair 270 (S5). Next, at a matched timing with the writing of image at the image forming portion 201B, the control unit 280 starts to drive the registration roller pair 270 according to the created speed control sequence (S6). In S6, the drive of the registration roller pair 270 is started to send the sheet to the secondary transfer portion 218, and thereafter, the sheet passes the fixing portion 220 where image is transferred and fixed to the sheet. After the trailing edge of the sheet passes through the registration roller pair 270, the driving of the registration roller pair 270 is stopped before the leading edge of the following sheet reaches the registration roller pair 270 (S7). If an unprinted page exists, the processes of S5 to S8 are repeated. If printing of all pages included in the print job is completed, the print job is ended (S8).

As described, the speed control sequence according to the present embodiment depends on a conveyance direction length L of the sheet, the grammage classification of the sheet, and the feeding portion of the feed source. The following describes an actual example of speed control sequence.

A first actual example considers a case where a sheet of Thick Paper 1 having an irregular size with a length of 300 mm, that is, a width of 297 mm and a length of 300 mm, is fed from the second feeding portion 232. A graph illustrating a driving torque fluctuation of the image forming motor M4 in the pass-through section of the secondary transfer portion under the present condition is illustrated in FIG. 25, and a diagram illustrating the sheet position in the conveyance path is illustrated in FIG. 26.

Figure 25:
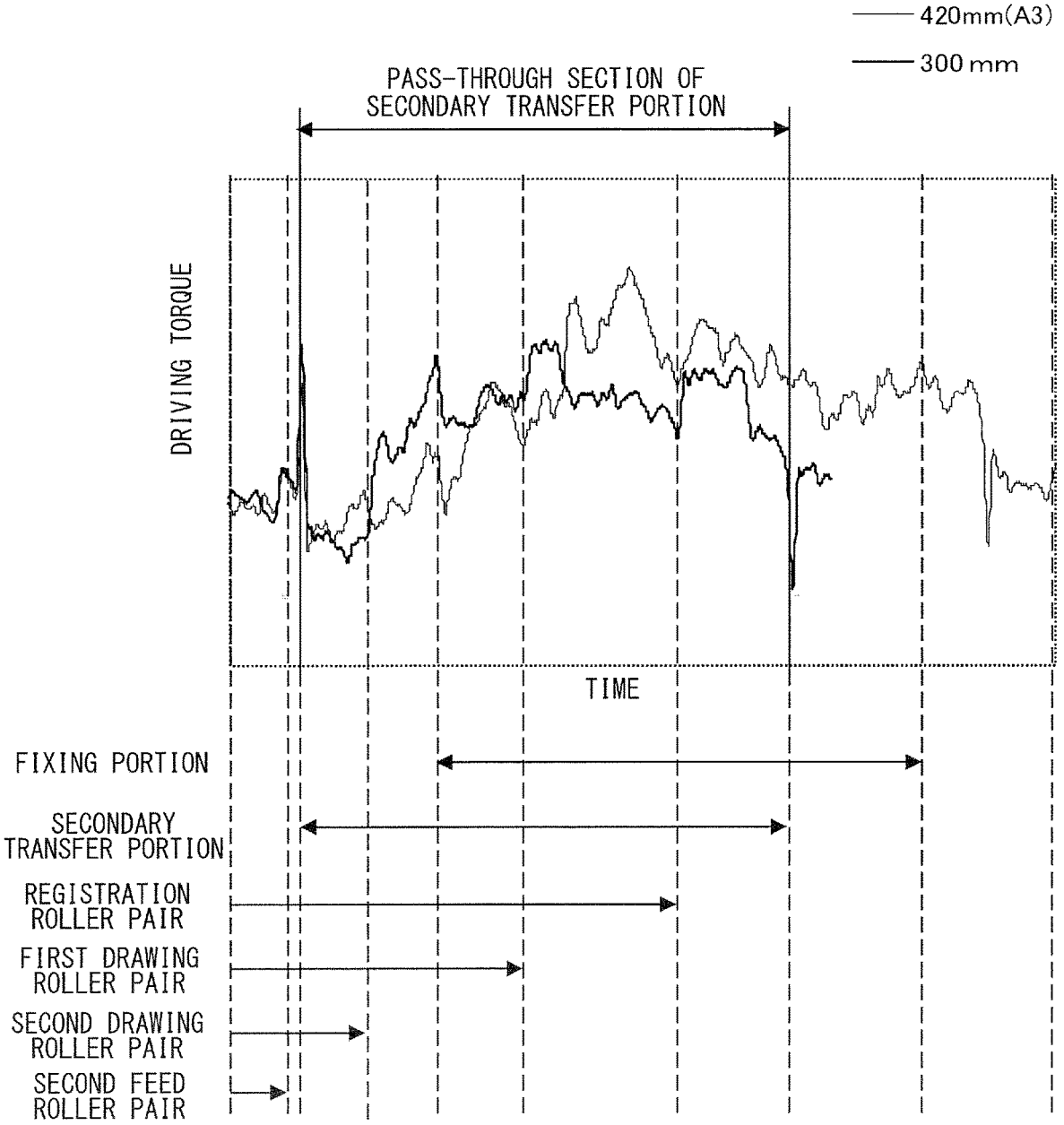
FIG. 25 is a graph illustrating differences in driving torque fluctuation of an image forming motor according to different sheet sizes.
Figure 26:
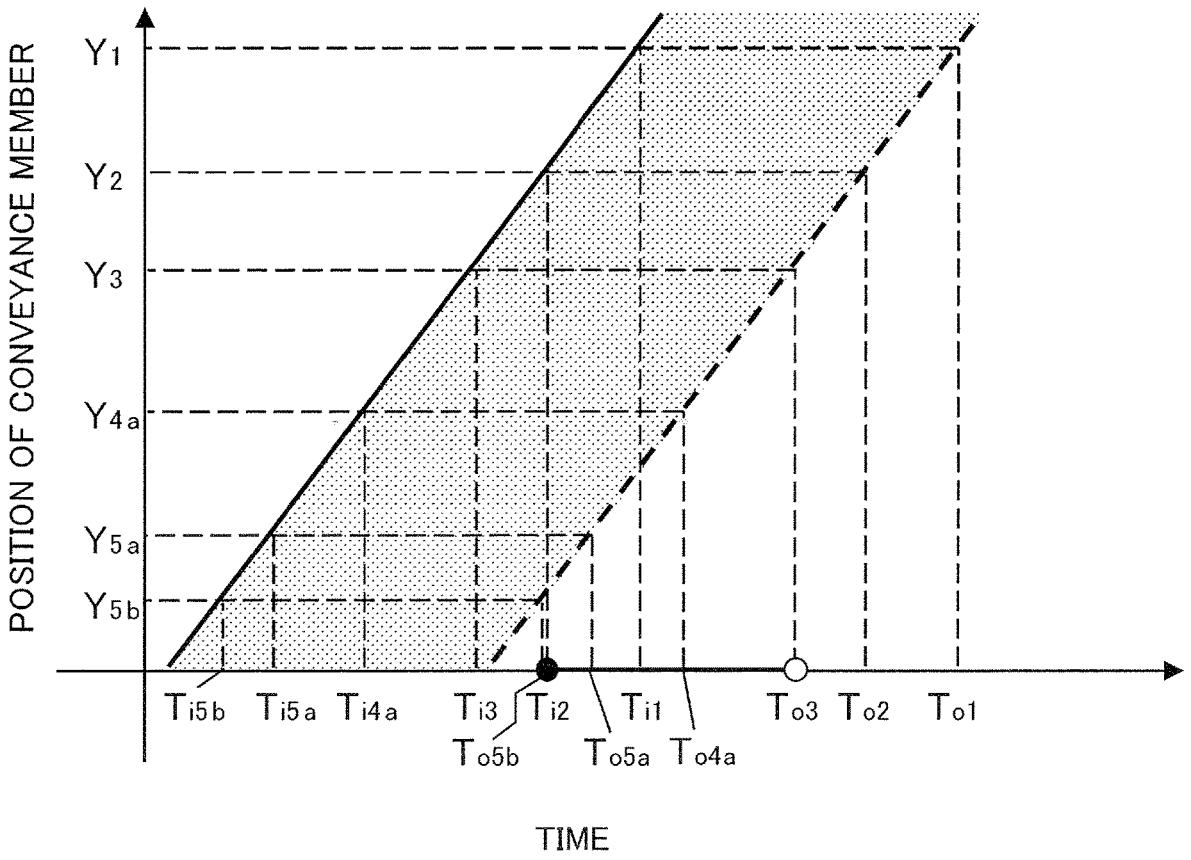
FIG. 26 is a diagram illustrating change of position of a sheet on a conveyance path according to the second embodiment, in a case where a sheet having a length of 300 mm is fed from the second feeding portion.

It can be seen from FIG. 25 that even if sheets are fed from the same feeding portion, the transition of driving torque varies if the lengths of the sheets in the conveyance direction differ. Further based on FIG. 26, it can be seen that if the lengths of the sheets differ, the timings at which the leading edge of the sheets enter the respective conveyance members are not varied, but the timing at which the trailing edges pass therethrough are faster. In FIG. 26 where $T_{i3}<T_{o5b}<T_{i2}$, it can be recognized that after the leading edge of the sheet enters the registration roller pair 270, the trailing edge of the sheet passes through the second feed roller pair 252 before the leading edge enters the secondary transfer portion 218. In the case of the A3-size sheet illustrated in FIG. 20, the timing is $T_{i3}<T_{i2}<T_{o5b}$.

In this example, the length L of the sheet in the conveyance direction is 300 mm, so that the classification of length illustrated in FIG. 22 corresponds to No. 4, and speed control sequence is created based on the corresponding set value of speed. Accordingly, an optimized control sequence that corresponds to the driving torque fluctuation (FIG. 25) in a case where the sheet length is 300 mm is applied, and the speed fluctuation of the intermediate transfer belt 216 that leads to color misalignment may be suppressed effectively.

Figure 27:
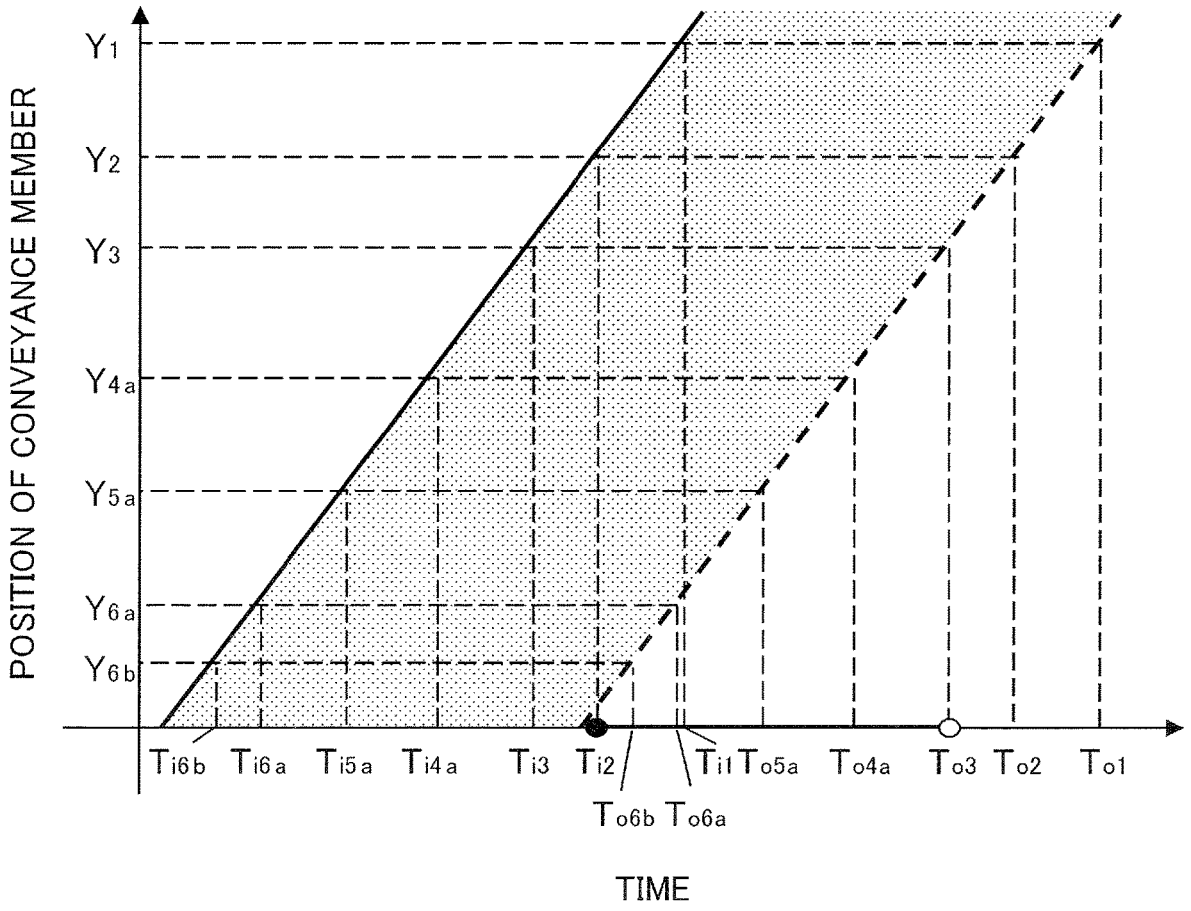
FIG. 27 is a diagram illustrating change of position of a sheet on a conveyance path according to the second embodiment, in a case where an A3-size sheet is fed from a third feeding portion.

A second actual example considers a case where a sheet of Thick Paper 1 having an A3-size with a length of 420 mm in the conveyance direction is fed from the third feeding portion 233. A diagram illustrating sheet position in the conveyance path under the present condition is illustrated in FIG. 27. The positions of the third drawing roller pair 263 and the third feed roller pair 253 in the conveyance path of the sheet fed from the third feeding portion 233 are respectively referred to as $Y_{6a}$ and $Y_{6b}$. Further, the times at which the leading edge of the sheet enter the roller pairs are respectively referred to as $T_{i6a}$ and $T_{i6b}$, and the times at which the trailing edge of the sheet pass therethrough are respectively referred to as $T_{o6a}$ and $T_{o6b}$.

By comparing the diagrams of FIG. 27 and FIG. 20 illustrating a case where the sheet is fed from the second feeding portion 232, even if the sheet length L is the same, the order of occurrence of conveyance timings and the intervals thereof are varied if the feed portions serving as feed source differ. If the feeding portions serving as feed source differ, the tendency of fluctuation of driving force of the image forming motor M4 caused by the force acting on the secondary transfer portion 218 from the sheet at each conveyance section also differ. Therefore, it can be recognized that when creating a speed control sequence, it is preferable to use a set value of speed that has been determined suitably according to the feeding portion serving as the feed source.

As illustrated in FIG. 28, when the sheet lengths are classified so that the order of conveyance timing with respect to the conveyance path of the sheet fed from the third feeding portion 233 are the same, the lengths of the sheet are classified into ten classifications. For example, the length of the A3-size sheet in the conveyance direction is 420 mm, the set value of speed classified as No. 3 in FIG. 28 should be referred to.

As described, according to the present embodiment, regarding a sheet having an arbitrary length L in the conveyance direction, speed control sequence is created according to the feeding portion serving as feed source, the classification of length of the sheet in the conveyance direction, and the grammage classification of the sheet. Speed control of the registration roller pair 270 is performed based on the speed control sequence, and fluctuation of speed of the intermediate transfer belt 216 leading to color misalignment may be suppressed effectively with respect to various sheet sizes.

Modified Example 1

In the first embodiment described above, a speed control sequence determined in advance is read when executing a print job, and in the second embodiment, speed control sequence is created during execution of a print job. These embodiments are not in a mutually exclusive relationship, and both methods can be implemented in one image forming apparatus. For example, it may be possible to adopt the method of the first embodiment for sheets having regular sizes, such as "A4-size sheet with a length of 210 mm in the conveyance direction" and "A3-size sheet with a length of 420 mm in the conveyance direction", and to adopt the method of the second embodiment for sheets that do not correspond to regular sizes.

Modified Example 2

Further according to the first and second embodiments, in a configuration where a full-color toner image is transferred to the sheet through the image bearing members and the intermediate transfer belt 216 serving as the intermediate transfer body, a method for suppressing fluctuation of rotational speed of the intermediate transfer belt 216 caused by sheets is proposed. As a result, color misalignment caused by fluctuation of rotational speed of the intermediate transfer belt 216 is reduced. However, the present technique can be applied to a monochrome or direct-transfer type configuration where a monochrome toner image formed on a photosensitive member serving as an image bearing member is directly transferred to the sheet without interposing the intermediate transfer body. In this case, color misalignment of toner image will not occur, but if rotational speed of the photosensitive member fluctuates by force acting on the photosensitive member from the sheet at the transfer portion, distortion of image on the sheet in the conveyance direction, i.e., sub-scanning direction, occurs. Therefore, by performing speed control of the registration roller pair 270 in the same methods as described in the first and second embodiments, fluctuation of rotational speed of the photosensitive member caused by sheets can be suppressed, and an action to suppress distortion of image can be expected.

Modified Example 3

According further to the first and second embodiments, speed control sequence of sheets fed from the cassettes 241 to 244 or the manual feed tray 240 has been illustrated. The present technique is not limited to these examples, and it can be applied to sheets conveyed to the registration roller pair 270 through the duplex reverse portion 201D, for example. The upstream conveyance units in that case are reconveyance roller pairs 224 to 226 arranged in the reconveyance path R. Especially, the reconveyance path R is curved in a loop in many cases to recirculate the sheets, so that it is effective to cancel out the increase of conveyance load after the trailing edge of the sheet has passed through the reconveyance roller pairs 224 to 226 by accelerating the conveyance speed of the registration roller pair 270.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-086718, filed on Apr. 26, 2019, which is hereby incorporated by reference herein in its entirety.

What is claimed is:

1. An image forming apparatus comprising:

an image bearing member configured to bear a toner image and rotate;

a transfer member configured to form a transfer portion between the transfer member and the image bearing member and transfer the toner image at the transfer portion from the image bearing member to a sheet;

a conveyance unit arranged upstream of the transfer portion in a sheet conveyance direction and configured to convey the sheet toward the transfer portion;

an upstream conveyance unit arranged upstream of the conveyance unit in the sheet conveyance direction and configured to convey the sheet toward the conveyance unit;

a drive unit configured to drive the conveyance unit; and a controller configured to control the drive unit to change a conveyance speed of the conveyance unit so that, in a case where a trailing edge of the sheet in the sheet conveyance direction passes through the upstream conveyance unit after a leading edge of the sheet in the sheet conveyance direction has entered the transfer portion, the conveyance unit conveys the sheet by a first speed before the trailing edge of the sheet passes through the upstream conveyance unit, and by a second speed that is faster than the first speed after the trailing edge of the sheet has passed through the upstream conveyance unit.

2. The image forming apparatus according to claim 1, wherein the controller is configured to execute a first mode in a case where a sheet having a first grammage is conveyed, the first mode being a mode in which the conveyance speed of the conveyance unit is not changed between before and after a trailing edge of the sheet having the first grammage has passed through the upstream conveyance unit, and execute a second mode in a case where a sheet having a second grammage that is greater than the first grammage is conveyed, the second mode being a mode in which the conveyance speed of the conveyance unit is changed so that the conveyance unit conveys the sheet having the second grammage by the first speed before a trailing edge of the sheet having the second grammage passes through the upstream conveyance unit, and by the second speed after the trailing edge of the sheet having the second grammage has passed through the upstream conveyance unit.

3. The image forming apparatus according to claim 1, wherein the controller is configured to set a conveyance speed after the trailing edge of the sheet has passed through the upstream conveyance unit to one of different speeds according to a sheet type of the sheet.

4. The image forming apparatus according to claim 1, further comprising a conveyance guide configured to form a curved conveyance path between the upstream conveyance unit and the conveyance unit in the sheet conveyance direction.

5. The image forming apparatus according to claim 1, wherein the conveyance unit is a registration roller pair configured to correct skewing of the sheet and thereafter convey the sheet to the transfer portion based on a timing at which forming of the toner image to be borne on the image bearing member is started.

6. The image forming apparatus according to claim 1, wherein the controller is configured to change, at a timing corresponding to the trailing edge of the sheet passing through the upstream conveyance unit, the drive unit from a state of driving the conveyance unit by the first speed to a state of driving the conveyance unit by the second speed.

7. The image forming apparatus according to claim 1, wherein the controller is configured to execute a process of changing the conveyance speed of the conveyance unit at a timing corresponding to the leading edge of the sheet passing through a conveyance unit arranged downstream of the transfer portion if the leading edge of the sheet passes the conveyance unit arranged downstream of the transfer portion in the sheet conveyance direction before the trailing edge of the sheet passes through the conveyance unit.

8. The image forming apparatus according to claim 7, wherein the conveyance unit arranged downstream of the transfer portion is a fixing portion configured to fix the toner image transferred to the sheet at the transfer portion to the sheet.

9. The image forming apparatus according to claim 1, wherein the controller is configured to execute a process of changing the conveyance speed of the conveyance unit at a timing corresponding to the trailing edge of the sheet passing through a conveyance unit arranged further upstream of the upstream conveyance unit in the sheet conveyance direction if the trailing edge of the sheet passes through the conveyance unit arranged further upstream of the upstream conveyance unit after the leading edge of the sheet has entered the transfer portion.

10. The image forming apparatus according to claim 1, wherein the controller is configured to change, at a timing corresponding to the leading edge of the sheet in the sheet conveyance direction entering the transfer portion, the conveyance speed of the conveyance unit from the first speed to the second speed.

11. The image forming apparatus according to claim 1, further comprising:

a supporting portion configured to support the sheet; and a feed unit configured to feed the sheet supported on the supporting portion, wherein the upstream conveyance unit is a conveyance roller pair arranged between the feed unit and the conveyance unit in the sheet conveyance direction and configured to convey the sheet fed by the feed unit toward the conveyance unit.

12. The image forming apparatus according to claim 1, further comprising a supporting portion configured to support the sheet, wherein the upstream conveyance unit is a feed roller configured to feed the sheet supported on the supporting portion toward the conveyance unit.

13. The image forming apparatus according to claim 1, further comprising:

a reverse conveyance unit arranged downstream of the transfer portion in the sheet conveyance direction and configured to reverse a conveyance direction of the sheet to which image has been transferred on a first side of the sheet in the transfer portion; and a reconveyance path configured to guide the sheet reversed by the reverse conveyance unit toward the conveyance unit, wherein the upstream conveyance unit is a conveyance roller pair arranged on the reconveyance path and configured to convey the sheet reversed by the reverse conveyance unit toward the conveyance unit in a case where an image is to be formed to a second side of the sheet that is opposite from the first side.

14. The image forming apparatus according to claim 1, further comprising a plurality of image forming units each comprising a photosensitive member, each image forming unit being configured to develop a latent image formed on the photosensitive member into a toner image, wherein the image bearing member is an intermediate transfer body configured to bear the toner image transferred from each photosensitive member of the plurality of image forming units and convey the toner image to the transfer portion.

* * * * *